US005716313A

United States Patent [19]

Sigrist et al.

[11] Patent Number: 5,716,313

[45] Date of Patent: Feb. 10, 1998

[54] APPARATUS AND METHOD FOR FOLDING BLANKS

[75] Inventors: Albert Sigrist, Colombier, Switzerland; Roberto Rizzolo, Champ-du-Moulin, Italy

[73] Assignee: Philip Morris Incorporated, New York, N.Y.

[21] Appl. No.: 371,345

[22] Filed: Jan. 11, 1995

Related U.S. Application Data

[63] Continuation-in-part of Ser. No. 200,856, Feb. 22, 1994, Pat. No. 5,385,526, which is a continuation of Ser. No. 881,787, May 12, 1992, abandoned.

[30] Foreign Application Priority Data

May 16, 1991 [CH] Switzerland ..... 1468/91

[51] Int. Cl.[6] ..... B65H 45/12

[52] U.S. Cl. ..... 493/438; 493/446; 493/456

[58] Field of Search ..... 493/178, 180, 493/125, 127, 151, 438, 446, 456; 156/204, 443

[56] References Cited

U.S. PATENT DOCUMENTS 4,132,156 1/1979 Glaze, Jr. .

5,052,993 10/1991 Focke ..... 493/178

5,188,582 2/1993 Ullman ..... 493/456

*Primary Examiner*—Jack W. Lavinder

*Attorney, Agent, or Firm*—James T. Moore; James E. Schardt; Charles E. B. Glenn

[57] ABSTRACT

The present invention relates to a method and apparatus for folding by approximately 180° a first surface portion of a blank on a rotating drum about a score line onto a second surface portion of the blank. A shaping rail comprises a first surface for acting on a first side of the first portion of the blank to initiate folding the first portion about the score line, a second surface for acting on a second side, opposite the first side, of the first portion of the blank to complete the approximately 180° folding of the first portion about the score line, and a spiral edge for transferring the first portion of the blank from the first surface to the second surface. A first inner guide rail comprising a cylindrical outer surface facing the second surface of the shaping rail and a second outer guide rail having a cylindrical inner surface facing the first surface of the shaping rail are provided to further guide the blank during folding.

17 Claims, 17 Drawing Sheets

APPARATUS AND METHOD FOR FOLDING BLANKS

The present application is a continuation-in-part of U.S. patent application Ser. No. 08/200,856, filed Feb. 22, 1994, now U.S. Pat. No. 5,385,526, which in turn is a continuation of U.S. patent application Ser. No. 07/881,787, filed May 12, 1992, which has been abandoned.

This invention relates to packaging equipment, and more particularly to apparatus for processing cardboard packaging blanks, especially for cigarette boxes. The invention further relates to a method of processing such blanks.

The packaging of batches of articles, especially packs of cigarettes, requires a large number of operations. The present invention concerns particularly the processing of a cardboard blank for a box after it has received any sort of imprint, for publicity or otherwise, on one of its faces, has been cut, and has been scored as necessary for folding into a box. The operations to which the present invention relates consist in depositing one or more drops of adhesive on one or more surface portions of the blank, folding and turning down one or more surface portions or flaps, adjacent to the preceding surface portions, over these preceding surface portions, and pressing the turned-down surface portions tightly against one another in order to constitute one or more new reinforced surface portions, then impressing a code on some surface portion of the blank. Thereafter, the blank is conveyed to a packaging machine, where the box will finally be formed around the pack of cigarettes; this operation, however, no longer forms part of the present invention.

In the prior art, a machine carrying out the aforementioned operations is usually disposed just before or at the intake of a packaging machine. Such a processing machine is generally made up of a first part, where the blanks are stored and from which they are successively withdrawn and disposed consecutively on a conveyor belt, from which they are withdrawn opposite each work station where they undergo one or another of the operations mentioned above. Owing to the numerous movements of the blanks from the conveyor belt to each work station and back, it is difficult to work at high speed with such apparatus, where a processing rate of 400 blanks/min. can usually not be exceeded. Moreover, since each processing operation is carried out following the preceding one, on a downstream portion of the conveyor belt, prior art processing machines are quite large.

It is an object of this invention to provide an improved method and apparatus for processing cardboard packaging blanks, particularly blanks of cigarette boxes, which are capable of working at a high speed of production, viz., at a rate well above 400 blanks/min.

A further object of this invention is provide such apparatus which is much less bulky than prior art processing machines, with simplified synchronization of the various operations to be carried out.

Another object of this invention is to provide apparatus by means of which the presence or absence of a blank can be checked, as well as its correct positioning, in order to control the running of the packaging machine and thus reduce production losses due to pile-ups and stoppages of the machine.

To this end, in the apparatus according to the present invention, the improvement comprises a drum rotating about its longitudinal axis, having a circular cylindrical support surface, as well as means for holding the blanks on this cylindrical support surface; transfer means withdrawing the blanks one by one from a storage part in order to dispose them one after another on the cylindrical support surface of the drum; means for processing the blanks, and including at least one of the following means: checking means for verifying the correct presence, orientation, and alignment of a blank on a portion of the cylindrical support surface of the drum, means for depositing at least one drop of adhesive on at least one surface portion of the blank, means for folding at least one surface portion of the blank about at least one preformed fold, means for compressing at least one other surface portion bent over at least one surface portion on which at least one drop of adhesive has been deposited, means for impressing a code or a text on at least one further surface portion of the blank; as well as withdrawing means withdrawing the blanks one by one from the cylindrical support surface of the drum in order to dispose them on routing means for conveying them to the following machine, and control means for synchronizing the operation of the apparatus.

In the method of processing a packaging blank according to the present invention, the blank is withdrawn from a package by transfer means, the blank is deposited on a longitudinal portion of the cylindrical support surface of a drum, where it is held in place by holding means, after the transfer means have ceased their action, the drum being actuated with a sequential rotary movement, and at least one of the following processing steps is carried out: checking of the correct presence, positioning, as well as orientation of the blank by checking means, deposit of at least one drop of adhesive on at least one surface portion of the blank, introduction of at least one other surface portion of the blank into folding means where at least one fold is formed, introduction of the other surface portion or portions into compression means where they are pressed against the surface portion or portions which have received adhesive, impression of a code on at least one further surface portion of the blank, following which the blank is withdrawn from the drum by withdrawing means after the holding means have ceased their action.

The inventive apparatus and method have been developed, and will be described below, as applying to cardboard blanks for packs of cigarettes. However, it should be understood that everything described below may equally well apply to packaging made of cardboard or having a certain rigidity and intended for any use other than cigarette boxes.

The present invention relates to a method and apparatus for folding by approximately 180° a first surface portion of a blank on a rotating drum about a score line onto a second surface potion of the blank. A shaping rail comprises a first surface for acting on a first side of the first portion of the blank to initiate folding the first portion about the score line, a second surface for acting on a second side, opposite the first side, of the first portion of the blank to complete the approximately 180° folding of the first portion about the score line, and a spiral edge for transferring the first portion of the blank from the first surface to the second surface. A first inner guide rail comprising a cylindrical outer surface facing the second surface of the shaping rail and a second outer guide rail having a cylindrical inner surface facing the first surface of the shaping rail are provided to further guide the blank during folding.

A preferred embodiment of the invention will now be described in detail with reference the accompanying drawings, in which:

FIGS. 1A and 1B are top plan views of the back and front, respectively, of a blank for a cigarette box, with one surface portion, or flap, being shown bent back in FIG. 1B, FIGS. 2A and 2B are end and side elevations, respectively, of part of the processing apparatus, FIG. 2C is a side elevation of part of the processing apparatus comprising a modification of the routing means, FIG. 3 is a perspective view of the transfer means of the apparatus, FIGS. 4A–4C are a perspective view, a diagram, and a top plan view, respectively, of the checking and gumming means of the apparatus, a preferred arrangement of photoelectric cells being shown in FIG. 4C, FIG. 5 is a perspective view of the folding means of the apparatus, FIGS. 6A and 6B are perspective views of the impression means of the apparatus, FIG. 6B being on a larger scale, FIG. 7 is a perspective view of a design of the withdrawing means of the apparatus, FIG. 8 is a perspective view of a shaping rail, FIGS. 9A and 9B are side and front elevations, respectively, of a first embodiment of the present invention, FIGS. 10A, 10B, 10C, 10D, 10E and 10F show respective folding steps accomplished at the like-identified locations of FIG. 9B, FIGS. 11A and 11B are side and front elevations, respectively, of a second embodiment of the present invention, and FIGS. 12A, 12B, 12C, 12D, 12E, 12F and 12G show respective folding steps accomplished at the like-identified locations of FIG. 11B.

DETAILED DESCRIPTION OF THE PREFERRED EMBODIMENTS

Figure 1A:
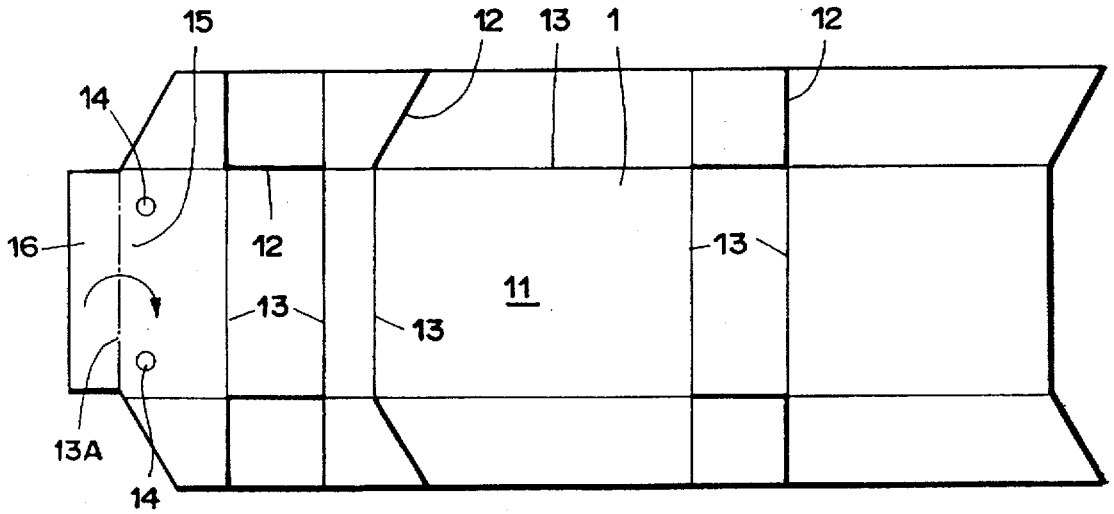

The folding mechanism of the present invention comprises a guiding device 60 in the shape of a spiral section and two pressure rollers 61 and 62. Since blank 1 is disposed on a cylindrical drum 3, the score about which fold 13A is to be made is curved according to the diameter of drum 3. When a conventional folding device or the device described below is used , difficulties may arise in making a precise fold due to this curvature of the fold line. Such a folding mechanism 6 is shown in FIGS. 2A, 2B, 2C and 5 which accomplishes the fold along line 13A shown in FIGS. 1A and 1B. Particular reference is made to FIGS. 8–12G showing two embodiments of the folding mechanism, the second being the preferred embodiment.

Figure 1B:
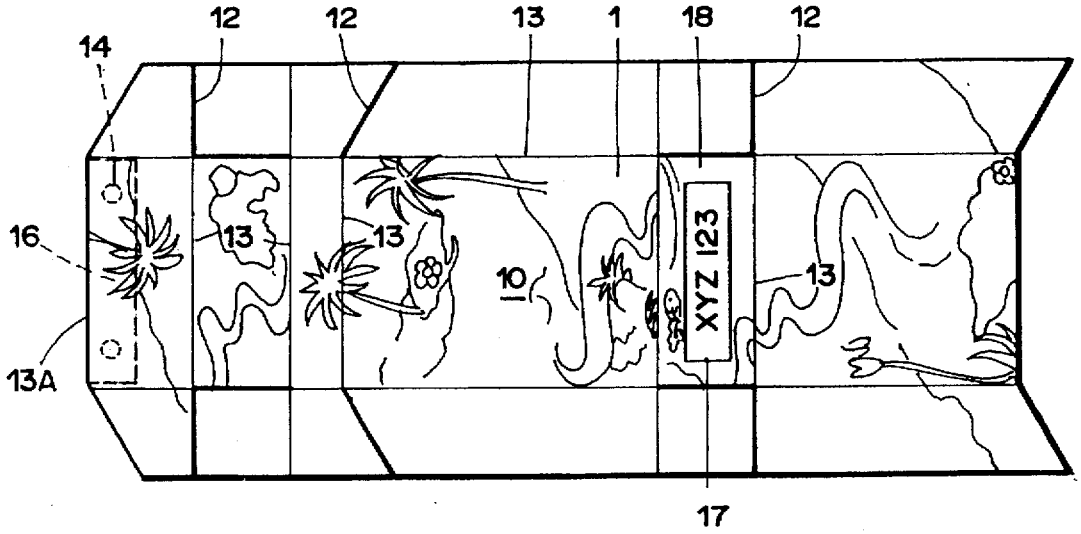

FIGS. 1A and 1B illustrate a specimen of a cardboard blank 1 intended to form the box for a pack of cigarettes, as readied for introduction into the processing apparatus according to the present invention. A face 10 of blank 1, the front of the blank, was first imprinted with some design or text, whereas the back 11 was left unprinted. Blank 1 was then cut to the desired shape, the blanking operation also including a number of cuts 12 clipped into the contour, shown as heavier lines, intended to facilitate the subsequent fashioning of the box. Simultaneously, a number of scoring lines 13, shown as lighter lines, were also made on the blank, corresponding to the subsequent folds of the box. The blanks prepared in this way, or in some other comparable manner, are supplied to the distribution means of the apparatus in the form of stacks, with all the superimposed blanks turned and oriented identically.

The operations to be carried out by the processing apparatus are:

seizing a blank from a supply stack, placing one or more spots of adhesive 14 on a surface portion 15 of the back 11 of blank 1, folding a surface portion 16, or flap, adjacent to surface portion 15, about a score 13A, laying surface portion 16 against surface portion 15 and gluing the two surfaces together in order to reinforce a portion of the box which will later serve as a gripping point for opening the pack of cigarettes, impressing a code 17 on a surface portion 18 of the front 10 of blank 1, and sending blank 1 thus processed to the packaging machine.

The operations described above obviously relate to the chosen example of processing a specific blank for a pack of cigarettes. However, other bending operations, with or without gluing, as well as other printing operations, may equally well be envisaged. By the same token, one or another of the mentioned operations may be omitted. The processing apparatus described below may therefore be adapted as a function of the operations to be carried out.

Figure 2A:
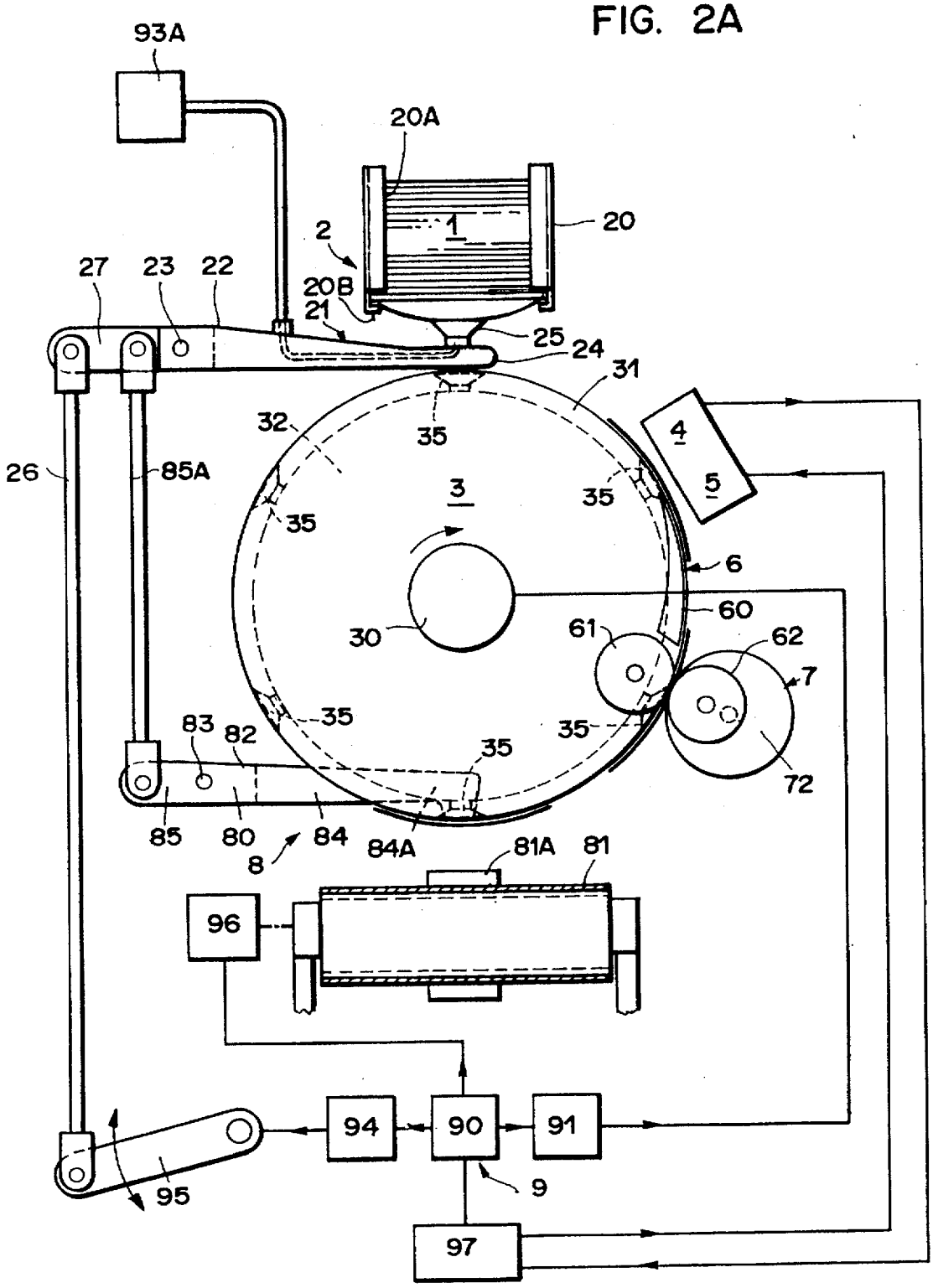
Figure 2B:
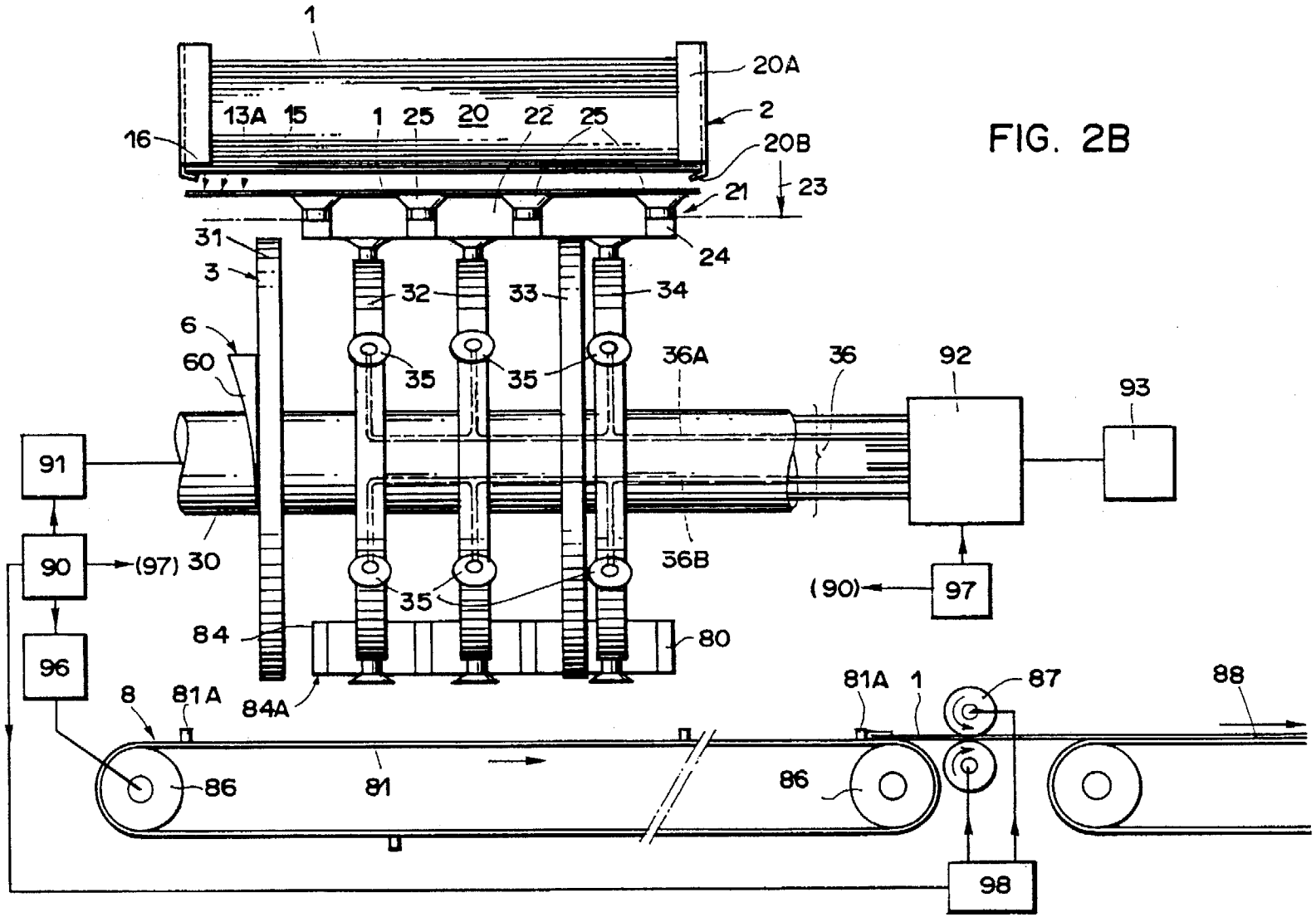

FIGS. 2A and 2B are partial elevations of the processing apparatus in a preferred embodiment of the invention, the apparatus being viewed from the end in FIG. 2A and from the side in FIG. 2B. The main elements making up the inventive apparatus are to be seen, particularly in FIG. 2A: distribution means 2, comprising storage means 20 and transfer means 21; a drum 3 about which checking means 4 and adhesive-depositing means 5 are disposed, jointly symbolized by a block 4/5; bending means 6, impression means 7, and blank-withdrawing means 8 including a withdrawal device 80 and means 81 for routing to the packaging machine, as well as driving, suction, and control means 9.

The main element of the inventive apparatus is drum 3, a preferred design of which is illustrated in FIG. 2B. It is made up of a longitudinal shaft 30 supported by two bearings of the machine (not shown) and driven in sequential rotation, e.g., by a motor 90, preferably an electric motor, on the shaft of which a conventional gearbox 91 is mounted, the output shaft of which has a movement of discontinuous rotation composed of portions of revolutions, between which the output shaft is stopped. Gearbox 91 is indexed in such a way that its output shaft effects portions of a revolution equal, in the present embodiment, to one-sixth of a revolution, between which longitudinal shaft 30, and thus drum 3, are stationary.

Shaft 30 bears a plurality of disks 31, 32, 33, and 34 disposed coaxially and in planes transverse to the longitudinal axis of shaft 30 and spaced from one another. Disk 31 is a support disk, while disks 32 and 34 are holding disks, and disk 33 has a dual function, being both a support disk and an impressing disk, as will be seen below. Support disks 31 and 33 have the same relatively large outside diameter, the outside cylindrical surfaces of these two disks defining the cylindrical support surface of drum 3 upon which the blanks are to be disposed. These blanks have been omitted from FIG. 2B in order not to clutter the drawing.

In the space separating support disks 31 and 33 are the two holding disks 32, while the third holding disk 34 is disposed outside that space, near disk 33. The outside diameter of holding disks 32, 34 is less than that of support disks 31 and 33. Suction nozzles 35, six for each of the holding disks 32, 34 in the embodiment illustrated, are disposed along the peripheries of these holding disks, spaced at regular intervals, e.g., every 60° in this example (see FIG. 2A). The diameter of holding disks 32 and 34 and the height of suction nozzles 35 are such that the suction surfaces of these nozzles are tangent to the cylindrical support surface of drum 3 defined by the support surfaces of support disks 31 and 33, as stated above. The suction nozzles 35 of each of the holding disks 32, 34 are mutually aligned on generatrices of the mentioned cylindrical support surface.

Shaft 30 is preferably hollow, its central cavity being occupied by a plurality of suction ducts 36, six in the embodiment illustrated; only two of these ducts, 36A and 36B, are shown in their entirety in FIG. 2B in order not to clutter the drawing. It will be noted that duct 36A is connected to three suction nozzles 35 disposed on a single generatrix, whereas the other duct 36B is connected to the three nozzles 35 disposed on another single generatrix. In other words, each of the nozzles 35 disposed on the same generatrix is connected to the same independent suction duct. The other ends of ducts 36 are connected to a conventional distributor 92 for controlling the suction of the nozzles 35 disposed on a given generatrix as a function of the operating steps of the blank-processing apparatus, as will be seen below. Distributor 92 is connected to a conventional suction installation 93. In this way, suction may be selectively controlled for each row of nozzles 35, so that a blank 1 can be held by the vacuum created by three nozzles 35 aligned on a generatrix of the cylindrical support surface of drum 3.

Storage means 20 of distribution means 2 may be seen in FIGS. 2A and 2B, disposed exactly above drum 3, perpendicular to the longitudinal axis of shaft 30. They are preferably composed of four angle-irons 20A disposed vertically at the four corners of the stored stack of blanks 1, the stack being held at the bottom by portions of inclined walls 20B, so that the stack is held in storage means 20, but the blank disposed under the stack can be extracted from it by withdrawal from the bottom of the stack. All the blanks 1 are disposed in the stack with their front or printed faces 10 downward and the surface portion 16 to be bent at the left of the stack, as viewed in FIG. 2B, so that score 13A is situated slightly out of plumb with the outer circular face of cylinder 3, i.e., with support disk 31.

Figure 3:
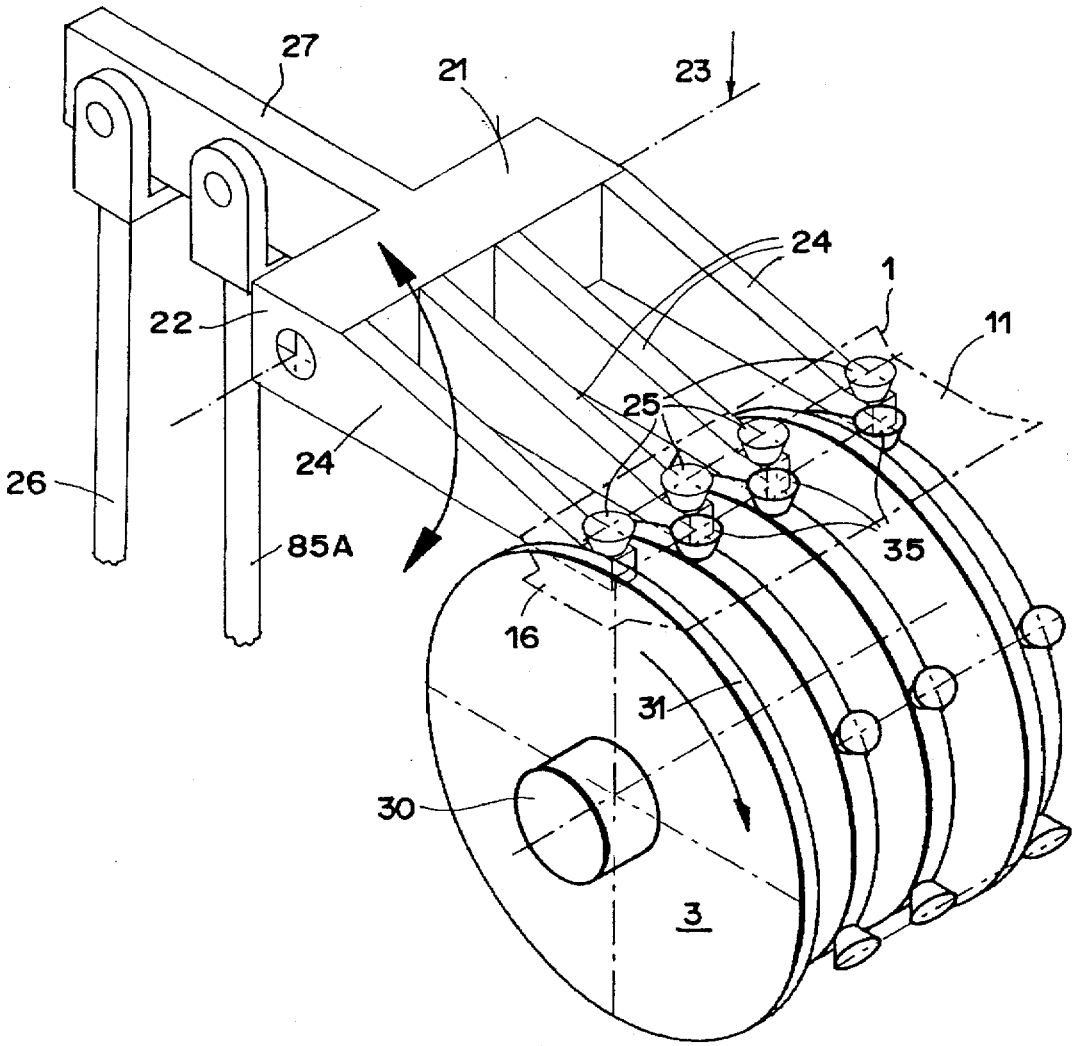

Transfer means 21 of distribution means 2 may be seen in FIGS. 2A, 2B, and 3A. These transfer means comprise firstly a middle part 22 pivoting about an axis 23 parallel to the axis of shaft 30 at the back of the processing apparatus and approximately between storage means 20 and drum 3. Extending from the side of part 22 nearest drum 3 are a plurality of seizing fingers 24, four in the example illustrated, projecting perpendicular to axis 23 and capable of entering the space occupied by drum 3 between disks 31, 32, or 33. As is seen in FIG. 2B, a first seizing finger 24 can pass between support disk 31 and the first holding disk 32, a second between the two holding disks 32 in the center, and a third between the second holding disk 32 and the second support disk 33, while a fourth passes outside the last holding disk 34, which is close to support disk 33. Any other respective arrangement of the disks and fingers may also be envisaged, according to the operations to be carried out. Each of the seizing fingers 24 is provided at the end thereof with a suction nozzle 25 similar to the suction nozzles 35 and facing upward. A single flexible conduit connects suction nozzles 25 to a conventional sequential suction installation 93A (see FIG. 2A), which may be the same as suction installation 93 mentioned earlier.

The oscillating movement of seizing fingers 24 about axis 23 is produced, as may be seen in FIG. 2A, by the overall driving motor 90 of the apparatus to which there is connected a conventional gearbox 94 converting the continuous rotational movement of the output shaft of motor 90, i.e., the primary shaft of gearbox 94, into a movement of angular oscillation of the output shaft of that gearbox. A crank-pin 95 mounted on the output shaft of box 94 transmits this oscillatory motion to a rod 26 connected to a lever arm 27 projecting from middle part 22 of transfer means 21 in the opposite direction from seizing fingers 24. Crank-pin 95 is connected to rod 26, and rod 26 to lever arm 27, by conventional pivot couplings. Thus, the rotary movement of motor 90 is converted into an oscillatory motion of crank-pin 95, which motion is transmitted to seizing fingers 24 via rod 26 and lever arm 27. Hence the oscillating movement of seizing fingers 24 is absolutely synchronized with the rotary movement of motor 90 and is such that seizing fingers 24 rise and fall once every one-sixth of a rotation of drum 3.

Figure 4A:
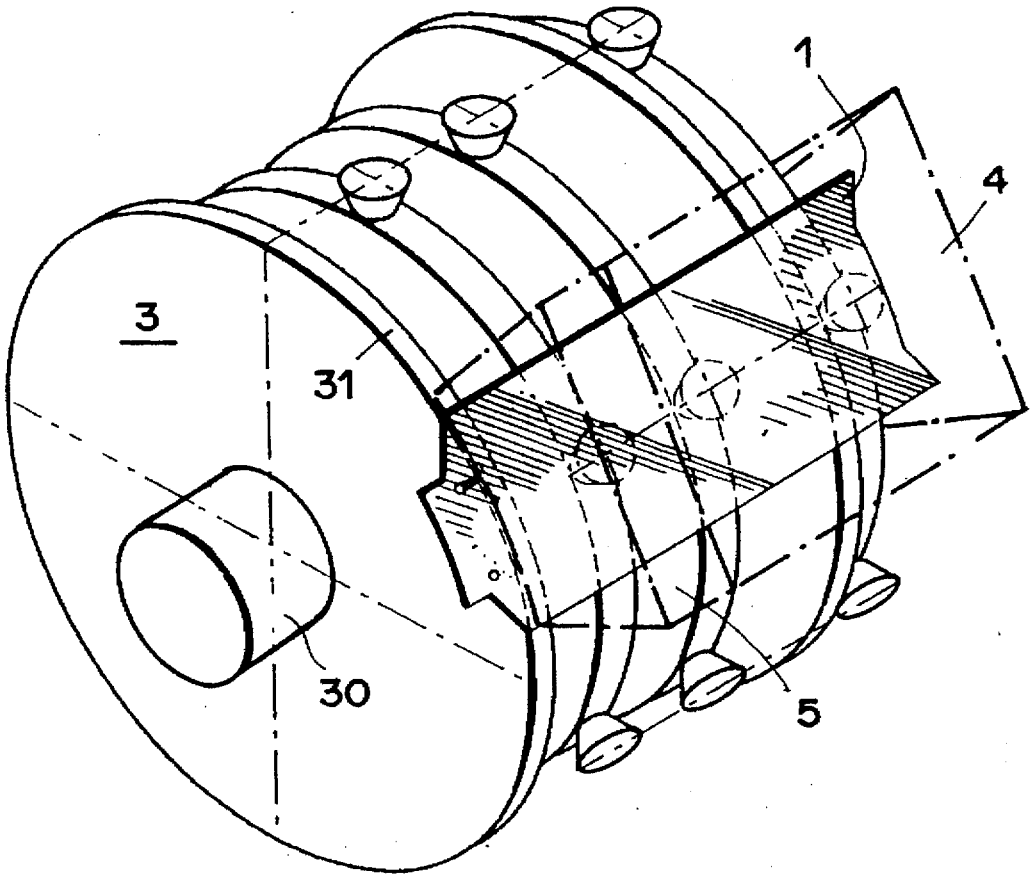

Thus, it is now possible to carry out the first operation, consisting in seizing the blank 1 situated at the very bottom of the stack held in storage means 20 and placing it on drum 3. For that purpose, drum 3 is momentarily stopped in such a way that a row of suction nozzles 35 is uppermost. Seizing fingers 24 are brought into their upper position, as shown in FIG. 2A, so that suction nozzles 25 are in contact with the underside of the blank 1 at the bottom of the stack. Suction source 93A is actuated, causing this blank to adhere to nozzles 25 while seizing fingers 24 start to move downward, as shown in FIG. 2B, whereby blank 1 is withdrawn from the bottom of the stack. Seizing fingers 24 continue to move downward and are inserted between disks 31, 32, 33, and 34, as explained above, until the underside of blank 1, i.e., its front 10, comes in contact with the nozzles 35 in uppermost position, as shown in FIG. 3A. At that moment, suction switch 92 actuates the suction of the nozzles 35 in the row at the top, while suction source 93A of the nozzles 25 of seizing fingers 24 is turned off. Seizing fingers 24 then continue to travel downward for a short distance in order to become completely disengaged from blank 1, which is now held by the suction of nozzles 35. Gearbox 91 then imparts a movement of rotation by 60° to drum 3 in order to advance blank 1 opposite checking means 4 and adhesive-depositing means 5, as illustrated in FIG. 4A. As soon as that position is reached, drum 3 again stops, and seizing fingers 24 return to their upper position in order to seize another blank 1 in the same way as just described.

As may be seen in FIG. 4A, checking means 4 and adhesive-depositing means 5 form a single unit disposed at an angle of 60° from the vertical and fixed to the frame of the apparatus in a manner known per se. As shown diagrammatically in FIG. 4A, and as may also be seen in FIGS. 4B and 4C, this unit passes above the blank 1 disposed on the nozzles 35, i.e., above the disks constituting drum 3. The unit will preferably be detachably fastened to or pivoted on the frame of the apparatus in order to give access to drum 3 in case of a breakdown.

Figure 4B:
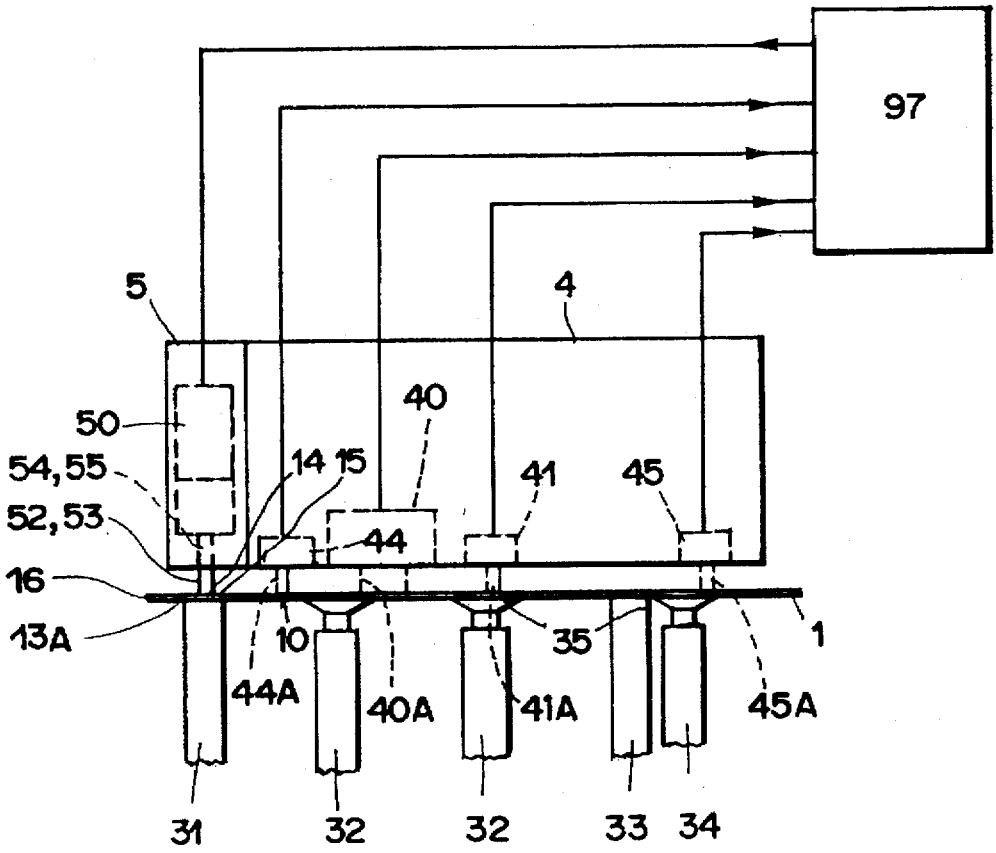
Figure 4C:
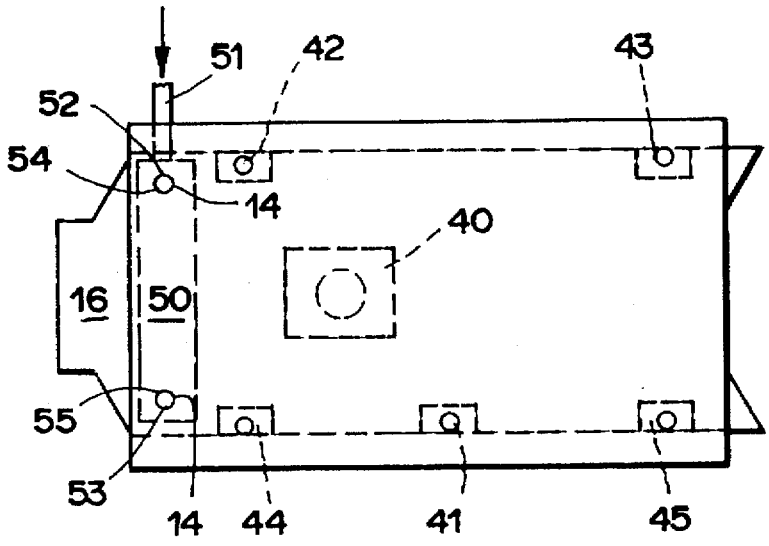

In this preferred embodiment, checking means 4 comprise a plurality of transceiving photoelectric cells 40–45, shown diagrammatically in FIGS. 4B and 4C, transmitting respective rays 40A–45A toward rear face 11 of blank 1, which reflects them back to the respective cells 40–45.

Cell 40, disposed facing an approximately central location of blank 1, is intended to determine whether blank 1 is correctly oriented, i.e., whether it is indeed back 11, its non-printed side, which is upward. If so, ray 40A, emitted by cell 40 and reflected by the substantially white back 11, returns to the receiving part of cell 40 with a higher amplitude than would be the case if the ray were reflected by the printed front 10 inasmuch as printed front 10 would reflect less light than back 11. If a blank is not properly oriented, cell 40 will control the stopping of the machine so that the wrongly positioned blank can be withdrawn, and the operator can check whether the following blanks in the stack held in storage means 20 are correctly or incorrectly oriented and rectify their positions, if necessary.

For purposes of the present description, a correctly oriented blank has its back 11 facing outward, while its front 10 is in contact with the cylindrical support surface of drum 3. There can be no error of orientation about an axis perpendicular to the plane of blank 1 since the asymmetrical shape of the blank it possible to provide for angle-irons 20A of a shape adapted to receive only blanks correctly oriented relative to that axis.

Cell 41 may be disposed at any location where its ray 41A can be reflected by back 11 of blank 1. It is simply intended to detect the presence of a blank and controls adhesive-depositing device 5, as will be seen below.

Cells 42–45 are disposed in two parallel lines spaced at a distance which is very slightly less than the width of blank 1. In this way, if a blank 1 is slightly crooked, two of the rays 42A–45A will not be reflected toward the corresponding cells. A fault of this kind also controls stopping of the apparatus.

It will be obvious that checking device 4, described here with six transceiving photoelectric cells, may be arranged in any other suitable manner, with cells of another kind or disposed differently or with more or fewer cells.

Adhesive-depositing device 5, which, in the embodiment of the processing apparatus being described, is mounted on the same unit as checking device 4, is situated opposite the portion of blank 1 comprising surface 15 on which two spots of adhesive 14 are to be deposited, i.e., outside support disk 31. It comprises particularly an injection device 50 fed by a duct 51 coming from an adhesive supply (not shown) and, controlled by cell 41 as stated above, injecting two streams of adhesive 52, 53 through nozzles 54, 55 toward the two spots 14 to be gummed. The adhesive-depositing device may obviously comprise a number of nozzles other than two, just as it might deposit a strip of adhesive instead of one or more spots 14.

As soon as these monitoring and adhesive-depositing operations have been carried out, drum 3 resumes rotating; and it is during this second 60° rotation that folding of flap 16 about score 13A and gumming of flap 16 to surface portion 15 via adhesive spots 14 is performed, as well as the operation of coding impression 17 on surface portion 18.

Figure 5:
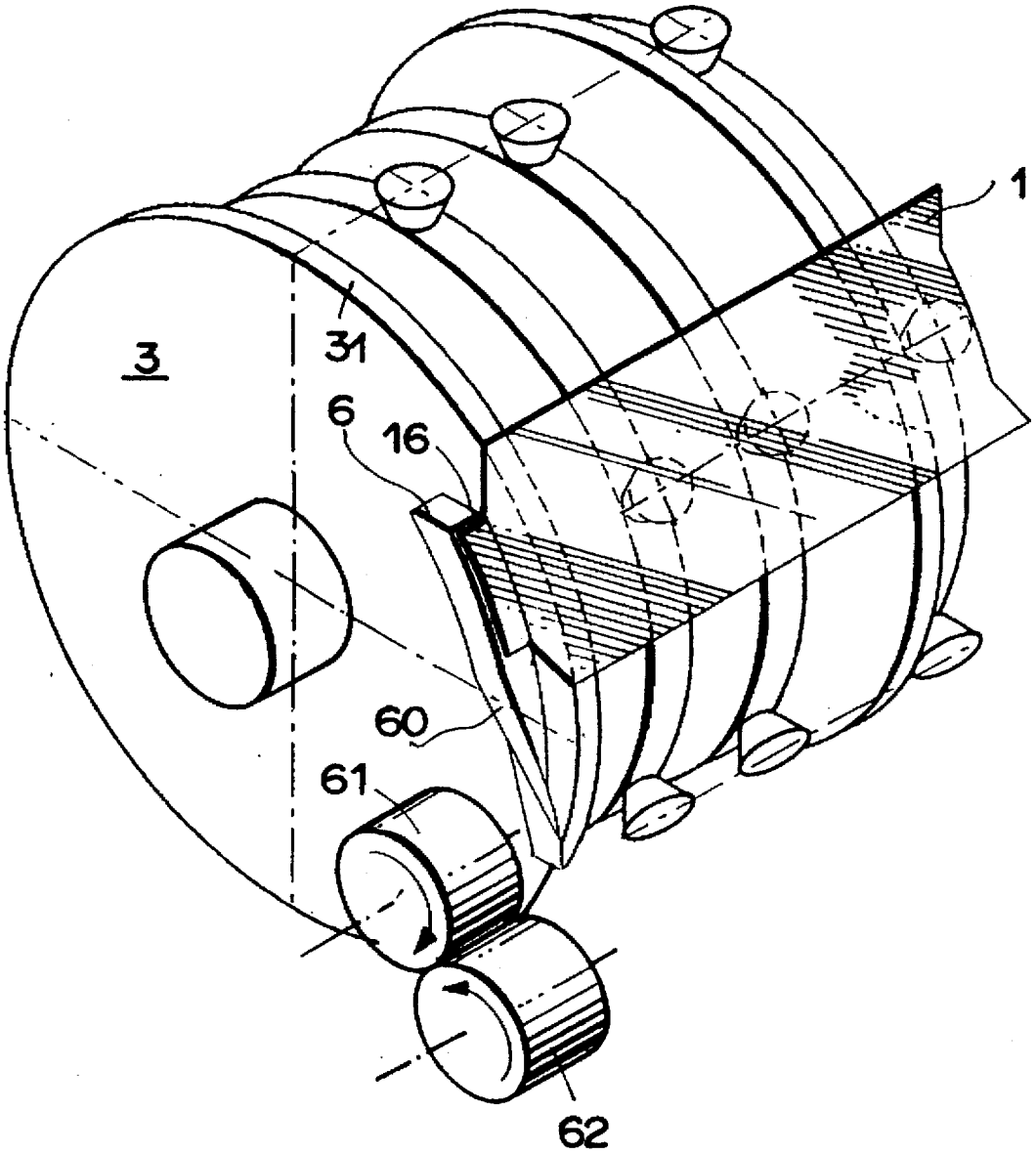

It has been seen earlier that score 13A is disposed slightly to the outside of the plane containing the outer edge of support disk 31. As soon as drum 3 resumes rotation after the previous operations, then as shown in FIG. 5, flap 16 enters bending device 6, disposed on the outer side of support disk 31 and made up firstly of a guide device 60 in the shape of a spiral section in which flap 16 is bent up along score. 13A and over surface portion 15. As soon as flap 16, bent over surface portion 15, leaves guiding device 60, blank 1 passes between two rollers 61 and 62 which are in contact along one of their generatrices and each rotate freely about an axis parallel to shaft 30.

Rollers 61 and 62 are situated on the outside of first support disk 31, the line of contact of the cylindrical outside surfaces of the two rollers being disposed in the previously defined cylindrical support surface and just after the exit end of guiding device 60. Since rollers 61 and 62 press firmly against one another, good adhesion of flap 16 to surface portion 15 is ensured by passage between the rollers of this surface portion, over which flap 16 has simply been bent, with drops of adhesive 14 previously placed between them. It will be noted in FIG. 2A that the centers of rollers 61 and 62 are aligned on a straight line passing through the center of drum 3, this line forming an angle of slightly less than 60° relative to the stopping position of drum 3 opposite unit 4/5.

Seeing that, in the embodiment being described, drum 3 rotates through an arc of exactly 60°, flap 16 is pressed onto surface portion 15 by rollers 61 and 62 when drum 3 is in motion, toward the end of its rotary movement when it is decelerating, in order that the excess torque exerted by the braking due to the pressure of the two rollers on flap 16 and surface portion 15 may not cause an increase in the driving torque of drum 3 but contribute to its braking.

Figure 6A:
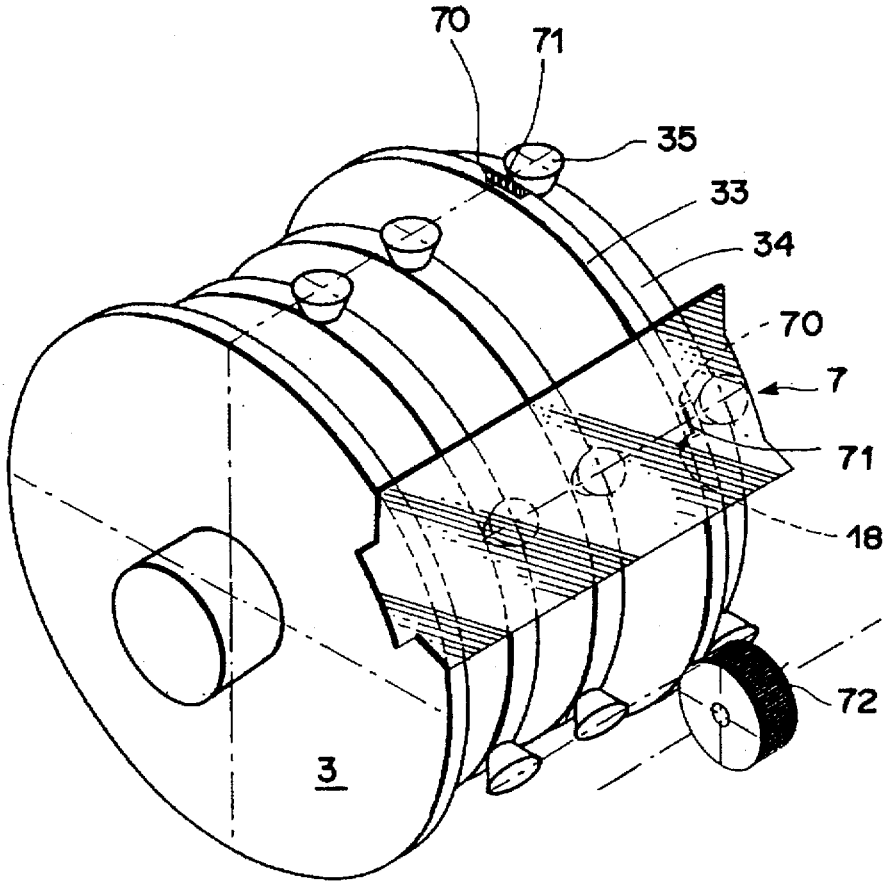
Figure 6B:
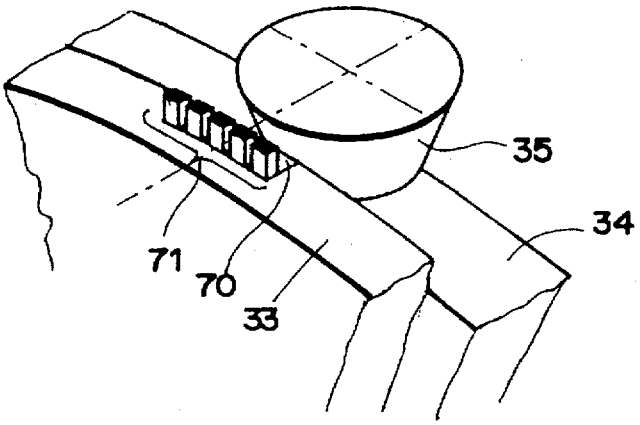

It has been stated above that disk 33 has a dual function, both as a support disk and an impressing disk. For that purpose, it is made up as shown in FIGS. 6A and 6B in a first embodiment. Disk 33 comprises on its cylindrical outer surface a plurality of notches 70—six in this embodiment—distributed every 60° along the circumference of the disk and each containing a printing block 71 composed of types which may either form a unit or be individually separable.

In another embodiment (not shown), notches 70 may be larger than shown in the drawing, each printing block 71 being made up of a plurality of small disks, the common axis of which is perpendicular to the axis of rotation of disk 33, each of these small disks comprising a plurality of types disposed on its periphery. The angular position of these small disks is indexable by means known per se, in such a way that in printing position, a succession of characters, each belonging to this particular small disk, appears on the outer circumference of disk 33.

These types may be of any kind, either figures or letters or symbols, or they may constitute a bar-code. Thus, it is possible to compose any sort of code, whether it be a date, a number, a product name, or some other useful indication. Printing blocks 71 are preferably identical in each of the notches 70, though they might equally well be different from one notch to another. Each of the blocks 71, or each type, may be pulled out of the notch and exchanged for another printing block or another type in order to change the code 17 printed on blank 1. The printing blocks 71 or types within the respective notch 70 are secured there in a manner known per se so that the printing surface of the block or the types is flush with the cylindrical support surface of disk 33. Printing blocks 71, or the types thereof, are self-inking, i.e., the ink necessary for printing reaches them from inside disk 33 in a manner known per se in the art of printing. In order for code 17 to be correctly printed on surface portion 18 of the front 10 of blank 1, a pressure roller 72, preferably of a rubber-like material, rotating freely about an axis parallel to the longitudinal axis of drum 3, presses surface portion 18 against printing block 71 as it passes under roller 72. The angular position of the axis of roller 72 is preferably the same as that of rollers 61 and 62, as may be seen in FIG. 2A, for the same reasons as explained earlier.

Thus, during the travel over the second arc of 60°, it has been possible to bend flap 16 and glue it to surface portion 15, as well as to print code 17 on surface portion 18.

At the time of the following stop of drum 3, when blank 1 is at the 120° position, no operation is performed on blank 1.

Figure 7:
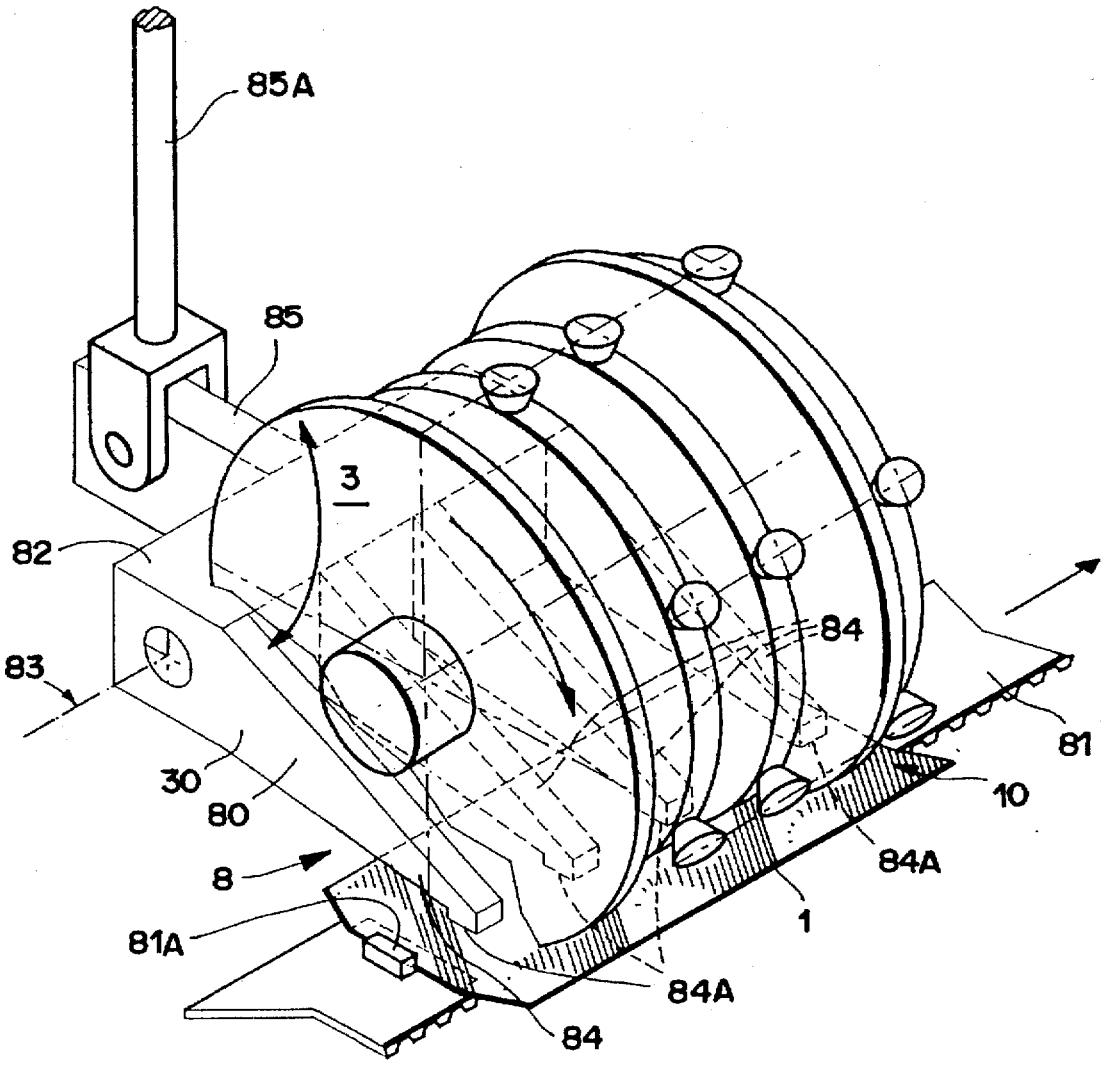

Blank 1 is withdrawn from drum 3 at the next stop of the drum in the following position, viz., at 180°. For understanding this step, reference may again be made to FIGS. 2A and 2B, as well as to FIG. 7. In the first embodiment described previously, withdrawing means 8 of the apparatus are composed mainly of a withdrawal device 80 and a discharge conveyor belt 81. Withdrawal device 80 also comprises a middle part 82 pivoting about an axis 83 parallel to the longitudinal axis of drum 3 and situated behind the drum, and a plurality of withdrawal fingers 84—four in the present example—extending from part 82 toward drum 3 and entering the spaces between the disks. Each withdrawal finger 84 is provided at the end thereof with a support surface 84A facing downward. Withdrawal device 80 further comprises a lever arm 85 projecting from middle part 82 in the opposite direction from fingers 84 and connected by a rod 85A to lever arm 27 of transfer means 21 in such a way that withdrawal fingers 84 are synchronized with seizing fingers 24, hence with the rotation drum 3. When blank 1 on drum 3 arrives at the 180° position, withdrawal fingers 84 with their support surfaces 84A are in their upper position, i.e., blank 1 comes to rest upon these support surfaces. At that moment, distributor 92 cuts off the suction feed to nozzles 35 disposed at 180°, thus releasing blank 1, which then drops onto conveyor belt 81. This movement is accompanied by withdrawal fingers 84 to ensure that blank 1 is duly separated from drum 3 and does not continue inopportunely to adhere to it.

It will be seen from FIG. 2B that conveyor belt 81 is an endless belt, the upper length of which travels in the direction indicated by an arrow, preferably in a direction parallel to the longitudinal axis of drum 3. Belt 81 travels over two rollers 86, one of them driven by motor 90 via a gearbox 96. The outside surface of belt 81 is provided with lugs 81A for advancing the blanks 1 lying on the belt, particularly for pushing the blank leaving the conveyor belt between two driving rollers 87 driven by another driving unit 98 and rotating at a higher peripheral speed than the speed of travel of conveyor belt 81 in order to accelerate the outgoing blank and to send it on, for example, to another conveyor belt 88 which will take it to the cigarette-packaging machine (not shown).

Figure 2C:
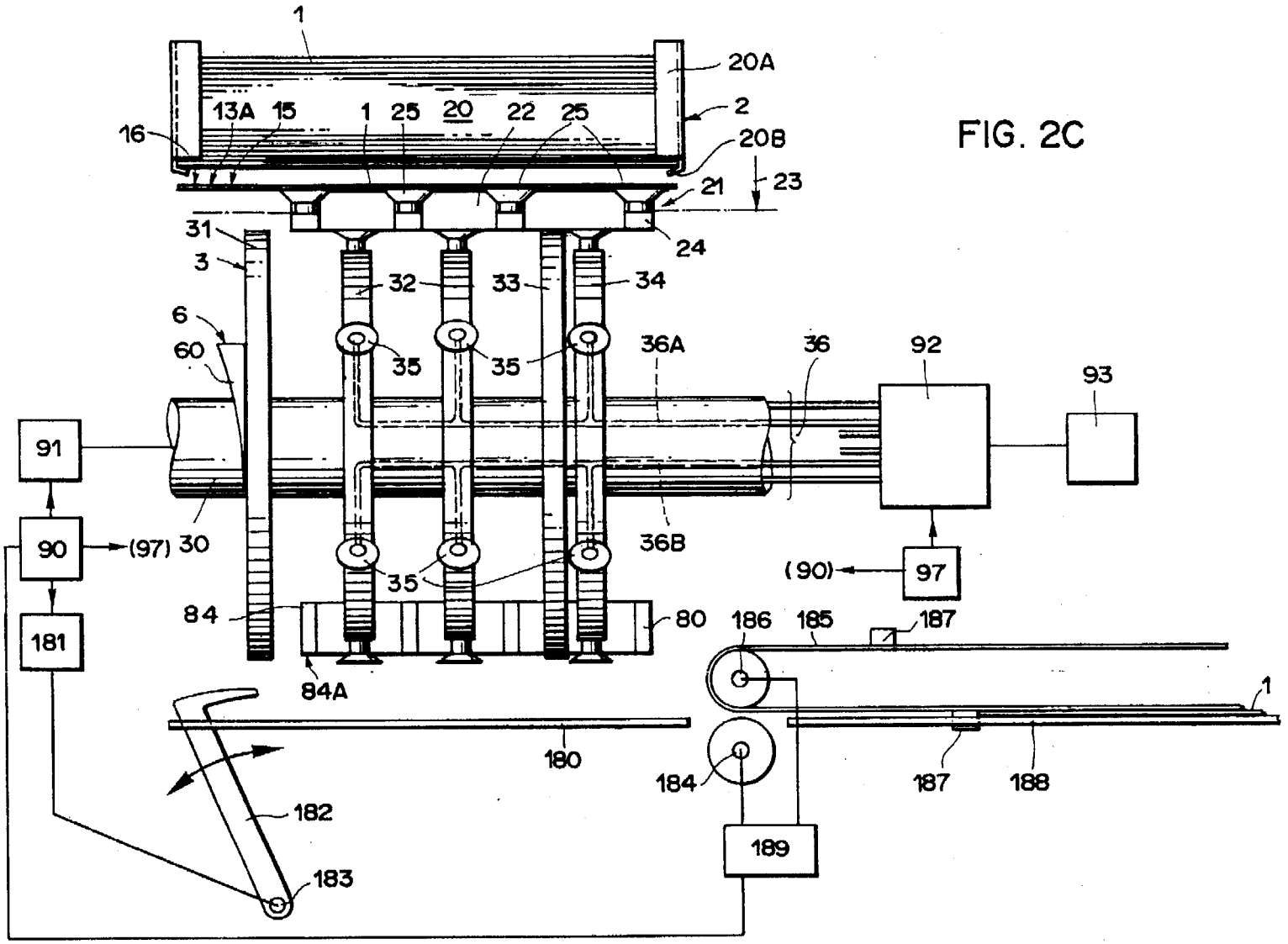

FIG. 2C shows a modification of the withdrawal means. Blank 1, detached from drum 3 in the same way as previously, drops onto a double slide bar 180 made up principally of two plane upper faces leaving a longitudinal empty space between them. A gearbox 181, driven by motor 90, actuates a lever device 182 pivoting about its axis 183, the top end of which device can travel in the empty space between slide bars 180. Gearbox 181 imparts to lever 182 a movement of displacement toward the blank 1 which has been deposited on slide bars 180, so that the blank 1 is accelerated along its longitudinal direction, slides on slide bars 180 and reaches a position where it can be seized between a roller 184 and a belt 185. At that moment, lever 182 can continue its rotation or be returned to the rear for carrying the next blank along. Belt 185, which is advanced by a roller 186, comprises lugs 187 projecting from the center of the belt so that the blank 1 is then pushed by a projection 187 as it slides on two other slide bars 188 which also have a free space left between them for the passage of projections 187. Rollers 184 and 186 are driven by motorized means 189.

Control means 9 further comprise a control unit 97, which may be a microprocessor card or a suitable computer, for synchronizing the various steps of the method and monitoring the operation of the apparatus. In particular, control unit 97 controls the running of driving motor 90, verifies the presence of the blanks on the drum via checking device 4 and cell 41, as well as the correct positioning of the blanks via cells 40, 42, 43, 44, and 45. Control unit 97 also controls distributor 92 so that suction through nozzles 35 is actuated between the 0° and 180° positions of the drum in order to hold blank 1 there, and is cut off between the 180° and 360° positions. Control unit 97 may also act upon the packaging machine situated downstream so that if a blank is missing on the processing apparatus, spotted by cell 41, or is wrongly oriented, spotted by cell 40, the batch of cigarettes which was to have been packaged in that blank is held back by the packaging machine and is therefore not wasted.

Various other embodiments or modifications of the inventive apparatus may be envisaged. For one thing, one or another of the operations—adhesive depositing, bending a surface portion, or printing—might be omitted or placed in a different location than that described; similarly, one or another of these operations might be carried out several times for processing a particular packaging blank. In that case, the described arrangement of the support and holding disks on the longitudinal shaft might be different, just as it might be necessary to provide for more or fewer stopping positions of drum 3 than the four described above (0°, 60°, 120°, and 180°) over half a revolution of the drum. If so, everything described above as relating to a 60° angle would have to be adapted accordingly. For example, if five stopping positions were needed (0°, 45°, 90°, 135°, 180°), the rotational sequences of drum 3 would be of 45°, and there would particularly be eight rows of nozzles 35 disposed every 45° on holding disks 32, as well as eight printing blocks 71. The diameter of the disks, hence the diameter of the cylindrical support surface of drum 3, would be increased accordingly. For another thing, it is just as conceivable to envisage differences in some of the mechanical particularities described; in particular, the means for synchronizing seizing fingers 24 and withdrawal fingers 84 with the driving of drum 3 might be electronic, pneumatic, hydraulic, or other means.

Thus, through the inventive apparatus and method for processing packaging blanks, especially blanks for packs of cigarettes, it is possible to feed a packaging machine at a high rate inasmuch as the blanks do not leave the drum throughout all the processing operations. Moreover, in view of the reduced size of this drum, the processing apparatus takes up appreciably less space than prior art apparatus. Since the apparatus is so compact and highly integrated, and owing to the positioning checks carried out, the synchronization means are simplified, thus greatly limiting both waste and shutdowns owing to jamming.

Figure 8:
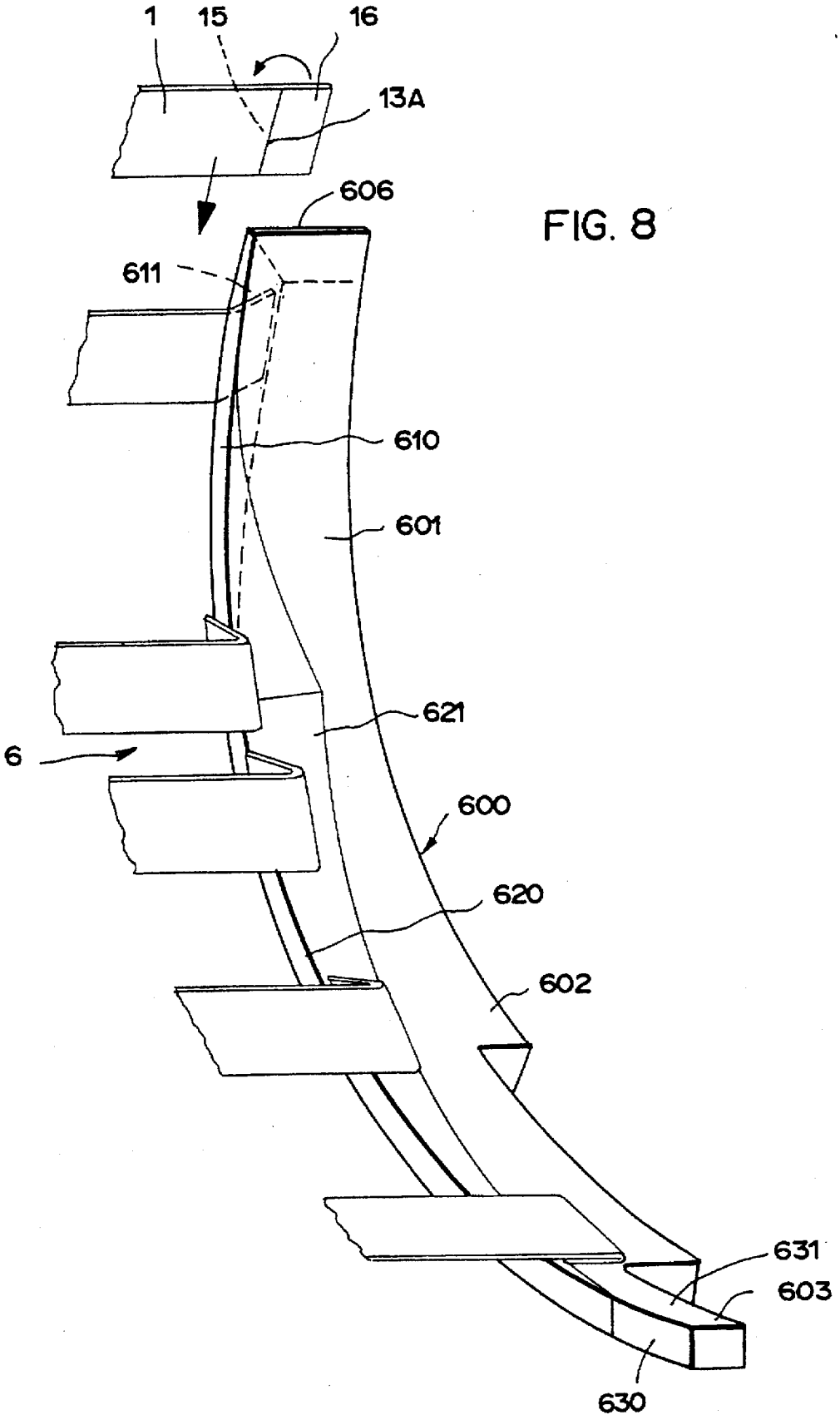

FIG. 8 shows in a perspective view the shaping rail 600 which is the main element of folding device 6, on which a plurality of portions of blanks 1 are passing along in order to describe different steps of turning down a surface portion 16 over the adjacent motion 15 about score line 13A. In order to be able to show several steps in the formation of fold 13A, the portions of blanks 1 depicted relate only to the central part at the end of the blank 1 of FIGS. 1A and 1B. Shaping rail 600 is made up of a preferably metal part having the general shape of a circular annulus segment, relatively thin. It includes a first portion 601 extending over approximately one-third of the length of rail 600, followed by a second portion 602 extending over the major part of the length of rail 600, then of a third relatively short portion 603 constituting the end of rail 600.

Figure 9A:
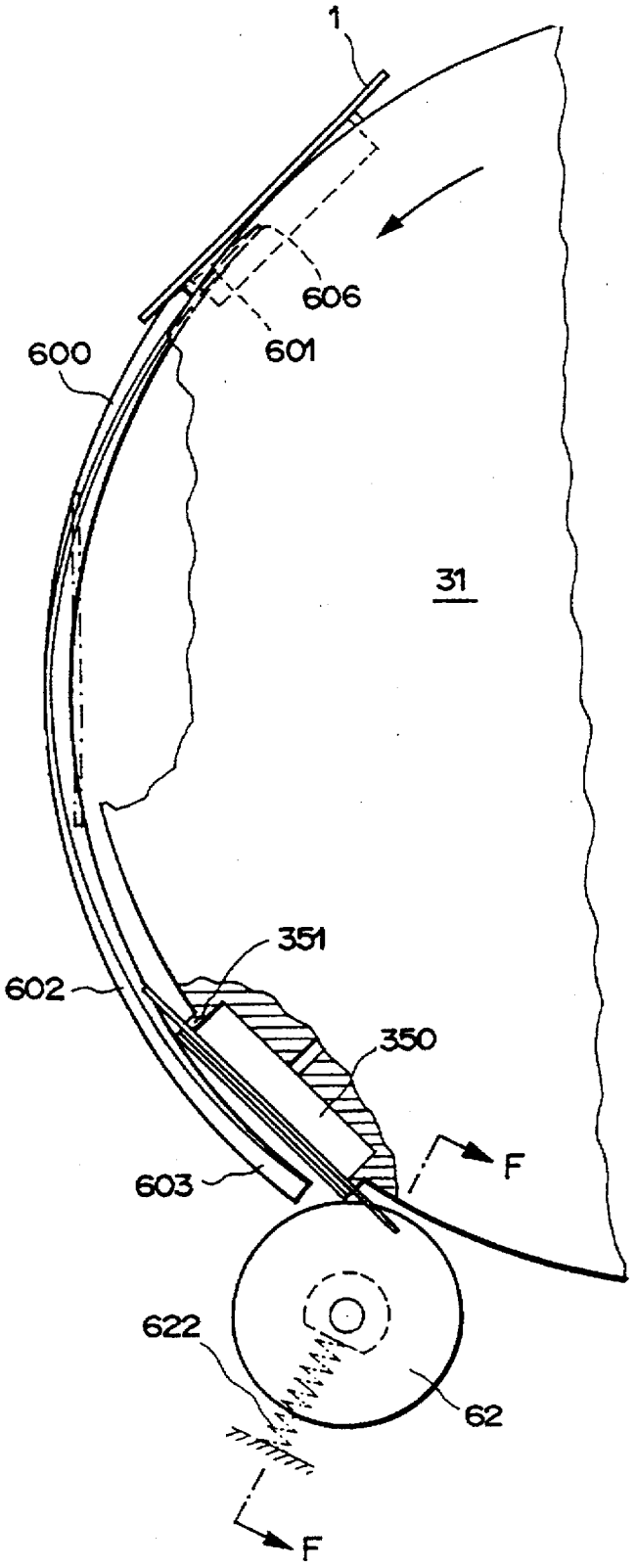
Figure 9B:
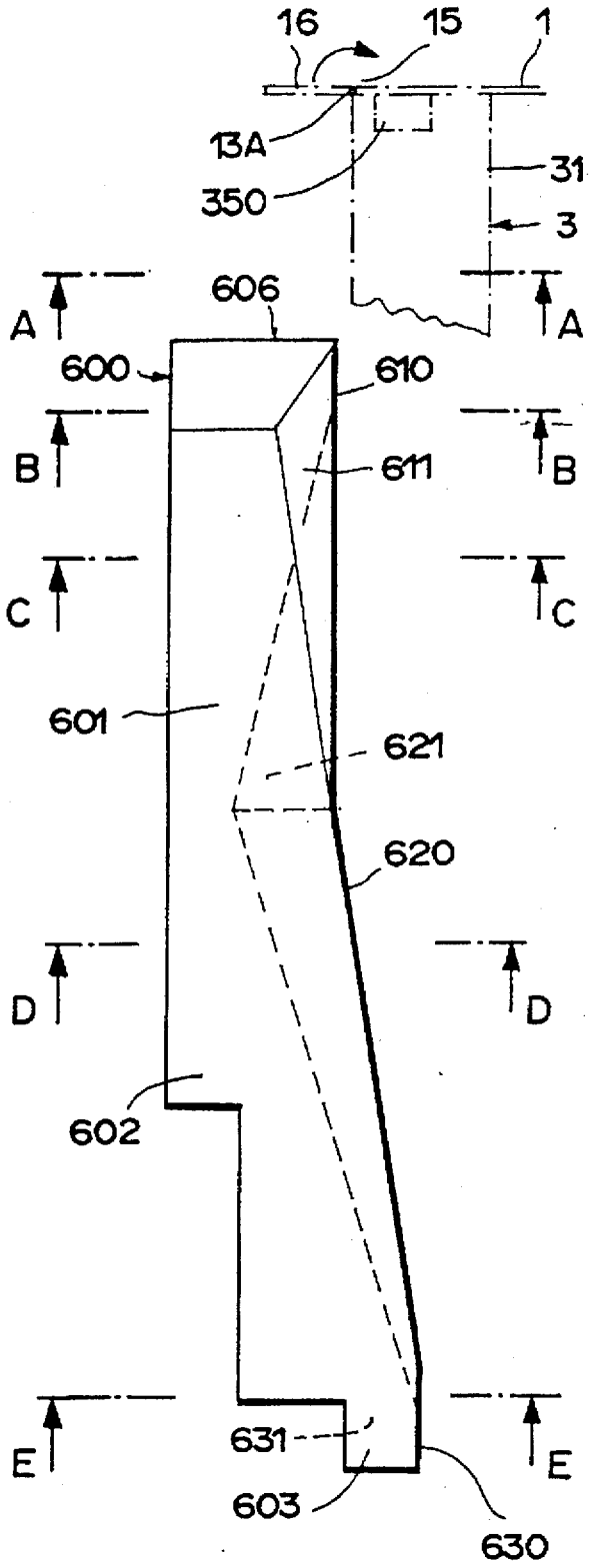

As is better seen in FIG. 9B, the edge 610 on the first portion 601 of rail 600 directed toward drum 3, or toward the first support disk 31; is perpendicular to the axis of drum 3, whereas the same edge 620 on the second portion 602 takes the form of a spiral directed toward drum 3, and the edge 630 corresponding to portion 603 is again perpendicular to the axis of drum 3. The outside face of portion 601, i.e., the convex part of this portion of rail 601 is beveled so as to present a surface 611 in the form of a frustoconical portion inclined in the direction of edge 610, the axis of the frustum of a cone coinciding with the axis of rotation of drum 3; the theoretical apex of this frustum of a cone would be on that axis, in the direction of drum 3.

It is seen in FIG. 9B that surface 611 has the general shape of a triangle, that its height increases rapidly from the upstream end of portion 601, i.e., from the nose 606 of that portion, up to a maximum value, then slowly decreases up to the end of portion 601. It may be recalled that the end of this surface 611 facing toward drum 3, or edge 610, is perpendicular to the axis of drum 3. On the other face of rail 600, i.e., on the concave part thereof, there is also a bevel defining another surface 621 in the shape of a frustoconical portion, the axis of which also coincides with the axis of rotation of drum 3, but the apex of which would be in the opposite direction from that of drum 3. Like the preceding one, this surface 621 has the general shape of a triangle, its height increasing from a point situated near nose 606 of portion 601 up to a maximum value situated on the line of meeting between portions 601 and 602, then decreasing on portion 602 to be cancelled on the line of meeting between portions 602 and 603. The end of this surface 621 turned toward drum 3 therefore corresponds to edge 610 on portion 601, then to edge 620 of helical shape on portion 602. Surface 631 corresponding to the concave inner face of portion 603 simply has the shape of a circular cylindrical portion.

Figure 11A:
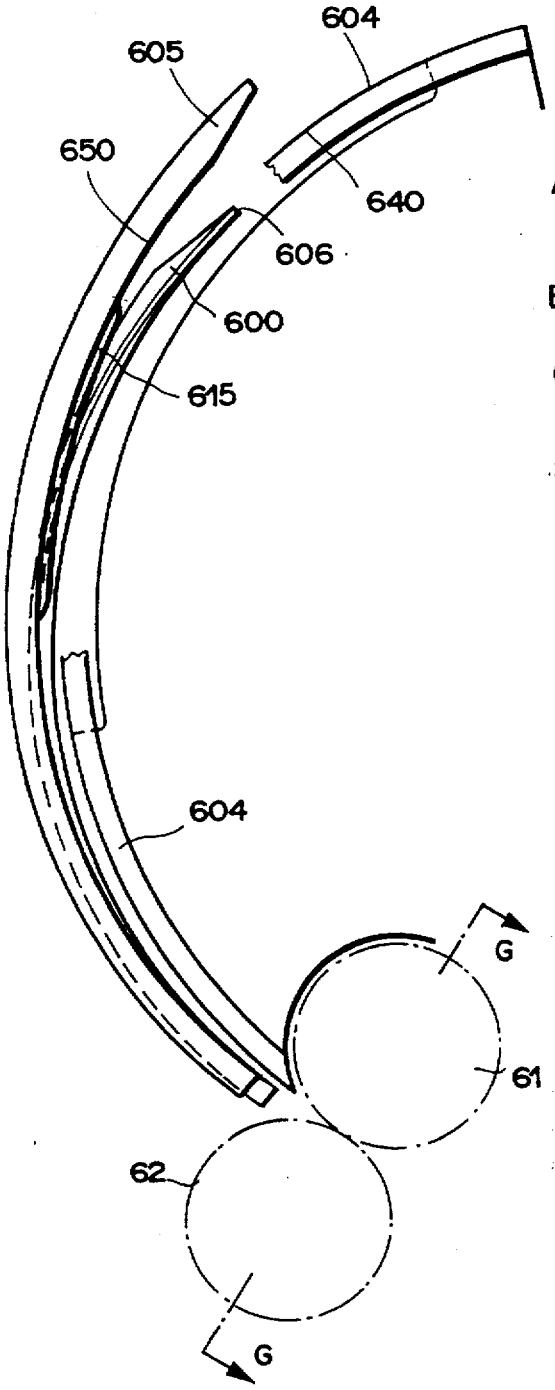
Figure 11B:
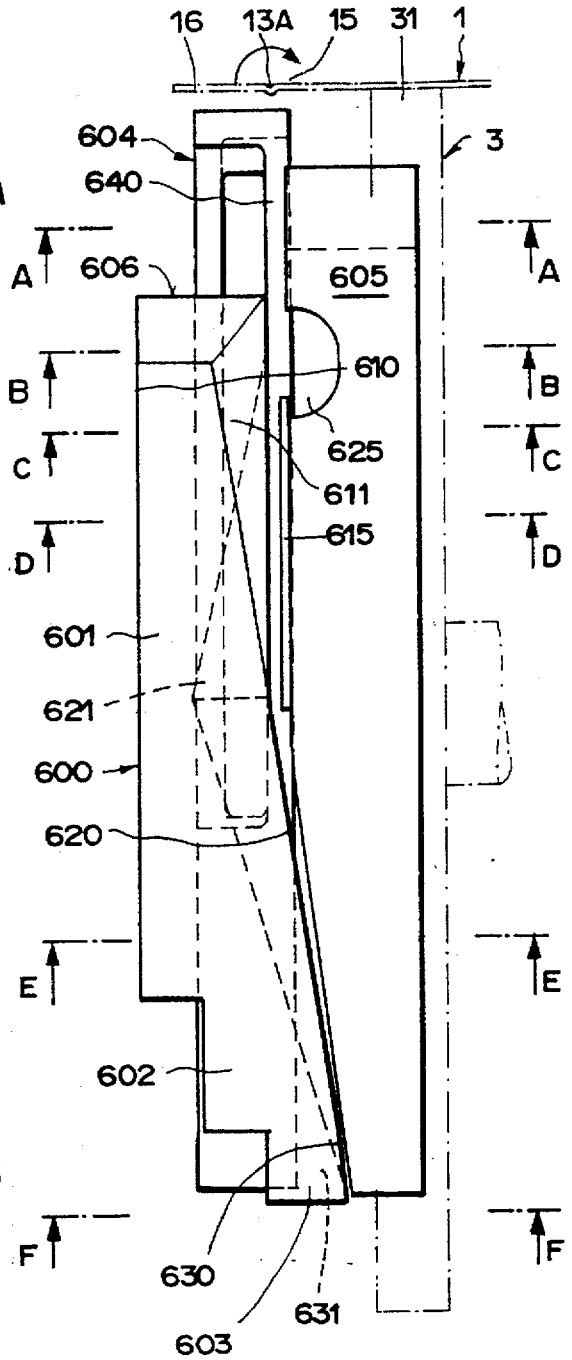

FIGS. 9B and 11B show a portion of a blank 1 seen in profile, disposed on rotating drum 3 and moving toward shaping rail 600 in order to fold surface portion 16 about score line 13A to bend it down on surface portion 15 as indicated by the arrow. It is noted that blank 1 is held on drum 3 in a position such that score line 13A is very slightly set back toward the drum relative to edge 610 of portion 601. The different folding steps may be followed now in FIG. 8. Blank 1 is thus presented upstream from portion 601 of rail 600, being positioned as has just been seen. When blank 1 fits along portion 601, portion 16 of the blank fits on the convex part of rail 600, or on the surface 611 situated on the other side of rail 600 as shown in FIG. 8, where portion 16 is starting to fold, being guided by surface 611. The angle of folding increases regularly until it reaches 90° at the moment when the blank arrives at the end of portion 601, i.e. at the beginning of portion 602, or at the location where spiral edge 620 starts. Through the effect of this spiral edge, the blank is then guided by surface 621 situated on the concave face of rail 600 where the fold continues to be formed until surface portion 16 is completely folded down on portion 15 when blank 1 arrives on portion 603. In the manner described, surface portion 16 of blank 1 has been bent down by 180° from the entrance of the blank on rail 600 until its exit.

Although the preceding description clearly shows the folding process, it is not complete inasmuch as it is necessary to hold the blank firmly in place and to guide it in order for the fold to be carried out correctly. For that purpose, a first embodiment of the means for holding and guiding the blank is shown in FIGS. 9A and 9B, their operation being described with regard to FIGS. 10A to 10F. These holding means are disposed on the first support disk 31, the surface of which on which blank 1 rests is wider than that shown in FIG. 5 discussed above, or else is shifted in the direction of shaping rail 600, so that blank 1 can rest on this surface up to score line 13A (see the top part of FIG. 9B). On this support surface of disk 31, suction nozzles 350 have been distributed along the same generatrices of drum 3 as the suction nozzles 35 described above. Suction nozzles 350 are connected to the same suction device as nozzles 35 and operate simultaneously therewith. If it is desired to have blank 1 remain quite flat during folding, a frame 351 may be provided, surrounding the mouth of each nozzle on the support surface of disk 31, thus defining a flat support surface, or else a flat may be created at the mouth of each nozzle (see FIG. 9A).

Several steps of the folding process are shown in FIGS. 10A to 10F, which respectively correspond to the state of blank 1 according to lines A to F of FIGS. 9A and 9B.

Figure 10A:
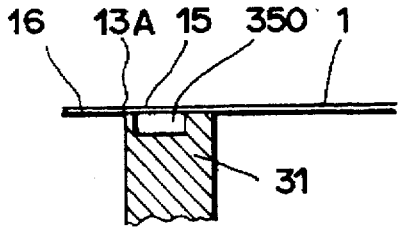
Figure 10B:
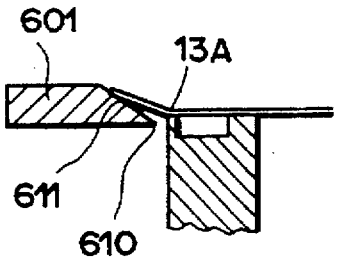
Figure 10C:
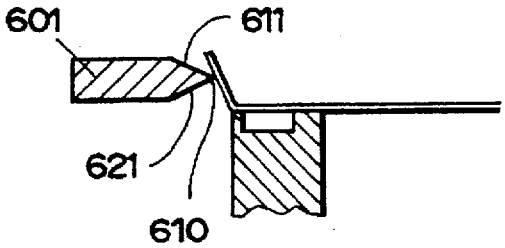
Figure 10D:
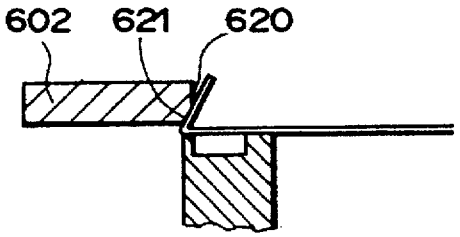
Figure 10E:
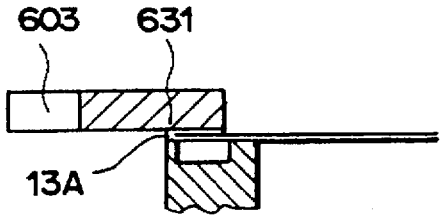
Figure 10F:
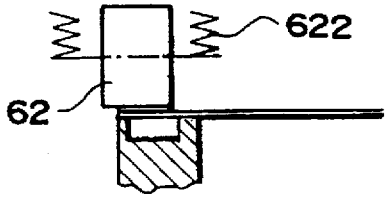

In FIG. 10A, blank 1 has not yet entered the folding device; it is firmly held on support disk 31, specifically by a suction nozzle 350. Portion 16 has then been inserted on the convex side of portion 601 of shaping rail 600 and therefore rests on surface 611, which starts to form the fold, as is seen in FIG. 10B. FIG. 10C shows still a later step, where portion 601 already includes surface 621 on its concave face; here the folding is carried out mainly by edge 610, which is still parallel to fold 13A. In the step shown in FIG. 10D, portion 16 has flipped over spiral edge 620 and is now guided by surface 621 of portion 602 of shaping rail 600. This flipping operation is caused by the shift of rail 600 relative to disk 31, as described below. When it arrives near the end of rail 600, or near portion 603 of this rail, portion 16 is completely bent down over portion 15, the fold being held by surface 631 against the support surface of support disk 31. In order to form fold 13A completely, the latter is then crushed by a roller 62 pressing firmly against the support surface of disk 31. In case the means described above for keeping blank 1 flat are installed on support disk 31, roller 62 is mounted on suspension means 622, e.g., spring means, in order to be able to keep a constant pressure despite the irregular shape of the support surface of disk 31. It has been mentioned above that an adhesive-depositing device for depositing one or more spots of glue is disposed before the folding device so that after folding, surface portion 16 adheres to the corresponding portion 15; the pressure exerted by roller 62 on portion 16 bent down on portion 15 resting on the support surface of support disk 31 permits this glued connection to be consolidated. Upon examination of FIGS. 10B to 10E, it may seem that rail 600, i.e., its portions 601, 602, and 603 or edges 610 and 620, move relative to the support surface of support disk 31; this is not the case, for rail 600 is absolutely fixed, this relative displacement effect being obtained by a shift of the surfaces of the cylindrical segment of rail 600 in relation to the cylindrical periphery of support disk 31, in such a way that nose 606 of portion 601 is tangent or slightly within the envelope of the periphery of support disk 31, and portion 603 is slightly moved away from this periphery (see FIG. 9A), support surface 631 of portion 603 then being coaxial with the cylindrical support surface of disk 31 in order to keep the fold closed, held between the two said surfaces, as is seen in FIG. 10E. In this way, edge 610, 620 of shaping rail 600 gradually passes from a position tangent to or beneath the cylindrical support surface of the disk to an outside position, parallel to said cylindrical support surface; blank 1 exactly following the periphery of disk 31 will have its portion 16 fit onto surface 611 disposed outside rail 600; then subsequently, after having flipped over edge 610, 620 at the moment when that edge crosses the cylindrical support surface of the disk, it will have portion 16 follow surfaces 621, then 631, situated within rail 600.

The second embodiment of the holding and guiding means described below corresponds to the preferred embodiment thereof; this embodiment is shown in FIGS. 11A and 11B, different steps of the action of these means during the folding process being shown in FIGS. 12A to 12G in the same way as previously. The folding and holding means of this embodiment are made up only of fixed and stationary elements with the exception of rotating drum 3.

In this preferred embodiment, shaping rail 600 is absolutely identical to the one described above; but contrary to the preceding embodiment, support disk 31 no longer comes in immediate proximity to score line 13A but comes distinctly set back from that line, as shown in FIG. 5 above or in FIG. 11B. The means for holding blank 1 during the folding operation comprise, besides those described above disposed on drum 3, a first, inner support rail 604 and a second support rail 605 provided with a support tongue 615, these elements as well as shaping rail 600 being fixed and stationary. The first, inner support rail 604 is made up of a circular annulus segment disposed within the concave surface of rail 600 so as to present a cylindrical support surface 640 in the exact prolongation of the support surface of disk 31; it generally furnishes a support to the back of blank 1 before and during folding thereof; consequently, the portion of circumference covered by rail 604 also extends upstream from that covered by rail 600. The second, outer support rail 605, too, is made up of a circular annulus segment; it is disposed parallel to rail 604, on the side toward drum 3, but is not exactly coaxial therewith. The concave face of rail 605 has a cylindrical surface 650 disposed opposite support surface 640 of rail 604, the space between surfaces 650 and 640 gradually decreasing, going from a large spacing toward the upstream parts of rails 604 and 605, leaving blank 1 relatively free between surfaces 640 and 650, to a reduced spacing toward the downstream parts of those rails where folded-over portion 16 is pressed upon portion 15 of blank 1, as will be seen below. During its passage along shaping rail 600, a portion of the back of blank 1 rests on a portion of cylindrical support surface 640, whereas a portion of the opposite face of blank 1 is guided or held by the second support rail 605. Score line 13A will therefore take on a curved shape during the course of that passage. The essential part of the second support rail 605 is made up of a support tongue 615 projecting from a circle portion of the inner side of rail 605 closest to shaping rail 600, this tongue having an edge directed toward support surface 640 of rail 604, and the length and position of which correspond approximately to that of surface portion 621 situated on portion 601 of rail 600 (see FIG. 11B). The way in which shaping rail 600 co-operates with the holding means constituted by first support rail 604 and second support rail 605 described above, in order to make the fold about score line 13A, is shown in FIGS. 12A to 12G.

Figure 12A:
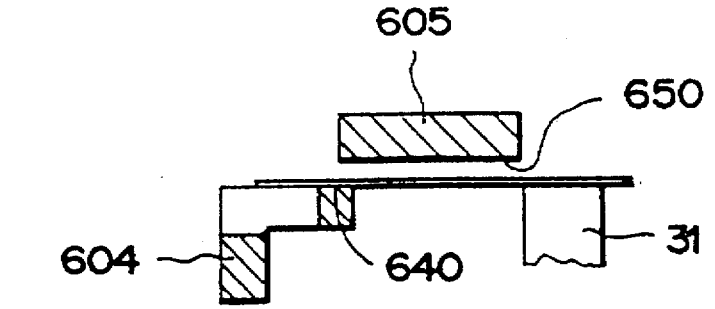
Figure 12B:
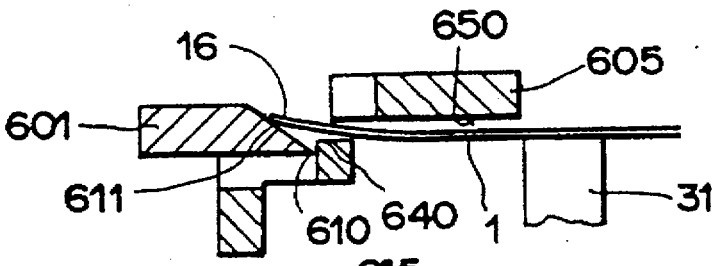
Figure 12C:
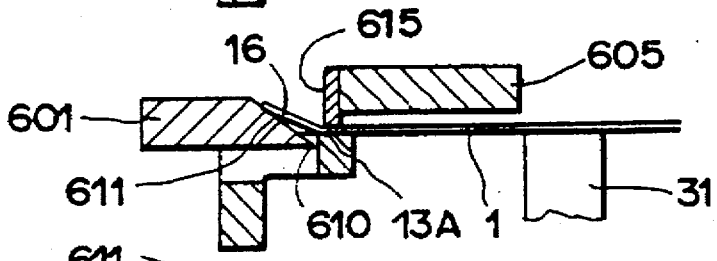
Figure 12D:
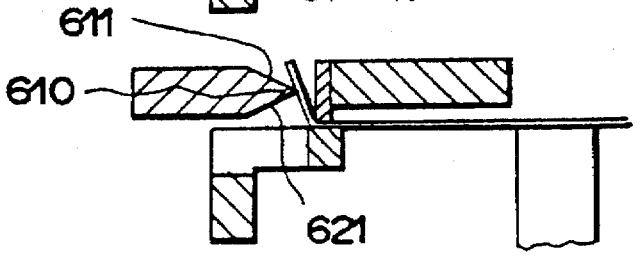
Figure 12E:
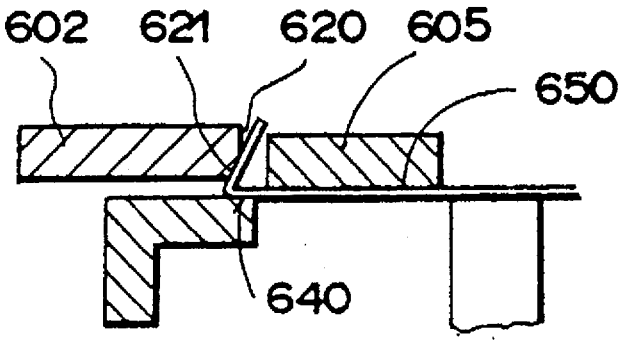
Figure 12F:
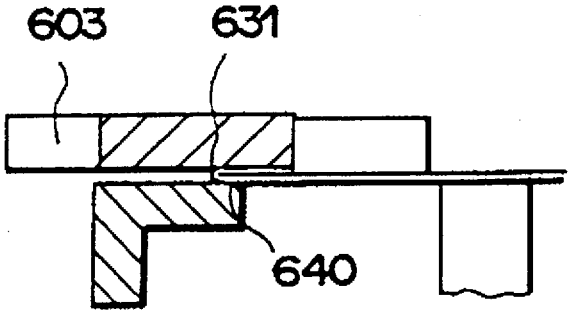
Figure 12G:
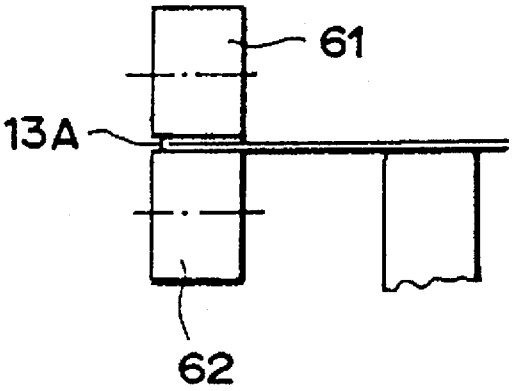

In FIG. 12A, blank 1 is held on drum 3 in the way described above. When it enters the folding device, the portion of it disposed behind score line 13A, i.e., on the side toward the rest of blank 1, comes to rest on support surface 640 of inner support rail 604 and fits under support surface 650 of outer support rail 605 without entering directly in contact with that surface. As its translatory movement continues, as shown in FIG. 12B, portion 16 of blank 1 encounters surface 611 of portion 601 of shaping rail 600. Through resting against surface 611, the end of blank 1 is slightly lifted; owing to the spacing of the two support surfaces 640 and 650, the portion of blank 1 including score line 13A can straighten out so as to be relatively straight at this location, i.e., not curved. Through the resting of portion 16 against surface 611 and then the fitting of the surface of the blank disposed behind score line 13A under the edge of support tongue 615, as seen in FIG. 12C, the fold about that score line may be initiated before score line 13A is again curved. It is further seen in this drawing figure that the fold is accentuated, at the same time as the curved shape of the blank, the surface portion slightly behind score line 13A being strongly pressed by the edge of tongue 615 against support surface 640. Next, as seen in FIG. 12D, the fold is more and more pronounced; the squeezing of blank 1 between the edge of tongue 615 and support surface 640 giving the curved shape described to the score line, co-operating with the increase in the angle of folding caused by the support surface in the form of a frustoconical portion 611, creates a flipping of surface portion 16 about score line 13A, the folding now being guided by edge 610. In FIG. 12E, it is seen that blank 1, after the mentioned flipping, has passed to the other side of rail 600 and is now facing portion 602 of rail 600. It is surface 621, the edge 620 of which has the spiral shape previously mentioned, which contributes to continuing the formation of the fold. In view of the acute angle between surface portion 16 and the rest of the blank, it is no longer possible to press directly behind the fold via tongue 615, and it is support surface 650 itself, co-operating with support surface 640, which holds the blank in place. In FIG. 12F, the fold is completely carried out. Blank 1 has fitted under portion 603 of shaping rail 600, the fold being held between surface 640 of rail 604 and surface 631 of portion 603 of rail 600, the two surfaces 640 and 631 being just spaced by a distance corresponding to twice the thickness of blank 1. It is then seen in FIG. 12G that after having left the shaping and support rails, the fold carried out on line 13A is strongly pressed between rollers 61 and 62 in order to break the fibers of the material forming the blank at the location of the fold in order to keep the latter from tending to open later on. This strong pressure of surface portion 16 against portion 15 also permits the previously mentioned gluing to be ensured. In FIG. 11B, an opening 625 in rail 605 is noted, this opening being intended to allow one or more glue-distributing nozzles to pass through.

The importance has been seen of the spacing between support surfaces 640 and 650 in the upstream part of rails 604 and 605 in order to permit the portion of blank 1 including score line 13A to straighten out momentarily so that this line may be approximately straight during a brief instant in order to initiate the folding of portion 16. The value of the spacing between the two surfaces 640 and 650 at this location depends essentially on the diameter of drum 3, i.e., of support surface 640, on the length of score line 13A, and on the elasticity of the material constituting blank 1, which might tolerate a slight curve of the score line to initiate the folding.

As indicated previously, in the device described above, only drum 3 is driven rotatingly, carrying blank 1 along through the folding or bending device which is itself made up only of fixed and stationary parts.

We claim:

1. Process for folding by approximately 180° a first surface portion located at one end of a blank about a score line onto a second surface portion of the blank adjacent to the first surface portion, comprising the steps of:

disposing the blank on a rotating drum such that the score line is in a plane tangent to a cylindrical outer surface of the drum and the first surface portion overhangs an end face of the drum, positioning a shaping rail comprising a generally circular annulus segment at the end face of the drum, a first portion of said segment at an upstream end of said rail having an outer convex face and a first edge directed toward the drum, and a second portion of said segment at a downstream end of said rail having an inner concave face and a spiral edge directed toward the drum, extended from the first edge and having a spiral shape gradually advancing in the direction of the drum, rotating the drum, and guiding, as the drum and the blank disposed thereon rotate, the first surface portion of the blank along the outer convex face toward the first edge, along the first edge, along the spiral edge and along the the inner convex surface to be folded approximately 180° about the score line onto the second surface portion.

2. Process according to claim 1, wherein the guiding step comprises positioning a first inner guide rail comprising a cylindrical outer surface facing said inner concave face of said shaping rail, and a second outer guide rail having a cylindrical inner surface facing the outer convex face at least until said spiral edge, wherein the first surface portion of the blank is guided between the cylindrical inner surface of said second outer guide rail and the outer convex face at least until said spiral edge and between the cylindrical outer surface of said first inner guide rail and the inner concave face of the shaping rail.

3. Process according to claim 1, wherein the disposing step comprises establishing pneumatic suction on a support surface of the drum.

4. Process according to claim 1, wherein said guiding step further comprises initially folding the score line at a right angle.

5. Process according to one of the claim 1, further comprising depositing glue on the second portion of the blank and applying pressure to press the folded first surface portion of the blank onto the second surface portion, wherein the glue joins the first and second surface portions.

6. Device for folding by approximately 180° a first surface portion located at one end of a blank about a score line onto a second surface portion of the blank adjacent to the first surface portion, the blank being disposed on a rotating drum, the score line being in a plane tangent to a cylindrical outer surface of the drum such that the first surface portion overhangs an end face of the drum, the device comprising:

a shaping rail comprising a generally circular annulus segment disposed at the end face of the drum, a first portion of said segment at an upstream end of said rail, and a second portion of said segment at a downstream end of said rail, said first portion comprising a first edge directed toward the drum and being generally parallel to the score line, a first outer convex face positioned beneath the overhanging first surface portion of the blank as the blank rotates with the drum and which comprises an outer frustoconical beveled surface, and a first inner concave face, said second portion comprising a second inner concave face positioned above the overhanging first surface portion of the blank as the blank rotates with the drum, said first and second inner concave faces comprising an inner frustoconical beveled surface, and a spiral edge directed toward the drum, extended from the first edge and having a spiral shape gradually advancing in the direction of the drum, wherein, as the drum and the blank disposed thereon rotate, the first surface portion of the blank is guided along the outer beveled surface toward the first edge, along the first edge, along the spiral edge and along the inner beveled surface to be folded approximately 180° about the score line onto the second surface portion.

7. Device according to claim 6, further comprising means for guiding the blank along said support rail.

8. Device according to claim 7, further comprising a support disk disposed on the drum, said support disk comprising a support surface which supports the second surface portion of the blank, said first surface portion overhanging said support surface, said support disk further comprising pneumatic suction means for holding the blank on said support surface during the folding of the first surface portion.

9. Device according to claim 8, further comprising means for depositing glue on the second portion of the blank, and means for applying pressure to press the folded first surface portion of the blank onto the second surface portion, wherein the glue joins the first and second surface portions.

10. Device according to claim 8, wherein said support surface of said support disk comprises support means permitting the blank to be kept flat on said support disk.

11. Device according to claim 10, wherein said means for applying comprise a pressure roller mounted on a shaft, wherein said support means comprise a spring suspension of the shaft.

12. Device according to claim 7, wherein said means for guiding the blank comprises a first inner guide rail comprising a cylindrical outer surface facing said first and second inner concave faces of said shaping rail, and a second outer guide rail having a cylindrical inner surface facing the outer beveled surface at least until said spiral edge, wherein the first surface portion of the blank is guided between the cylindrical inner surface of said second outer guide rail and the outer beveled surface of said shaping rail at least until said spiral edge and between the cylindrical outer surface of said first inner guide rail and the inner beveled surface of said shaping rail.

13. Device according to claim 8, wherein the cylindrical inner surface of said second outer guide rail comprises a projecting tongue having an edge which is parallel to the score line and disposed partially opposite the first portion and partially opposite the second portion of said shaping rail.

14. Device according to claim 13, wherein said second outer guide rail comprises, upstream from said projecting tongue, a concave support surface, spaced from the cylindrical outside said surfaces permitting the score line to be straightened out in order to initiate the folding of the first surface portion of the blank about the score line.

15. Device according to claim 6, further comprising means for depositing glue on the second portion of the blank, and means for applying pressure to press the folded first surface portion of the blank onto the second surface portion, wherein the glue joins the first and second surface portions.

16. Device for folding by approximately 180° a first surface portion located at one end of a blank about a score line onto a second surface portion of the blank adjacent to the first surface portion, the blank being disposed on a rotating drum, the score line being in a plane tangent to a cylindrical outer surface of the drum such that the first surface portion overhangs an end face of the drum, the device comprising:

a shaping rail comprising a generally circular annulus segment disposed at the end face of the drum, a first portion of said segment at an upstream end of said rail, and a second portion of said segment at a downstream end of said rail, said first portion comprising a first edge directed toward the drum and being generally parallel to the score line, a first outer convex face positioned beneath the overhanging first surface portion of the blank as the blank rotates with the drum, which comprises an outer beveled surface, said second portion comprising an inner concave face positioned above the overhanging first surface portion of the blank as the blank rotates with the drum, said inner concave face comprising an inner beveled surface, and a spiral edge directed toward the drum, extended from the first edge and having a spiral shape gradually advancing in the direction of the drum, wherein, as the drum and the blank disposed thereon rotate, the first surface portion of the blank is guided along the outer beveled surface toward the first edge, along the first edge, along the spiral edge and along the inner beveled surface to be folded approximately 180° about the score line onto the second surface portion.

17. Device for folding by approximately 180° a first surface portion located at one end of a blank about a score line onto a second surface portion of the blank adjacent to the first surface portion, the blank being disposed on a rotating drum, the score line being in a plane tangent to a cylindrical outer surface of the drum such that the first surface portion overhangs an end face of the drum, the device comprising:

a shaping rail comprising a generally circular annulus segment disposed at the end face of the drum, a first portion of said segment at an upstream end of said rail, and a second portion of said segment at a downstream end of said rail, said first portion comprising a first edge directed toward the drum and being generally parallel to the score line, a first outer convex face positioned beneath the overhanging first surface portion of the blank as the blank rotates with the drum, said second portion comprising an inner concave face positioned above the overhanging first surface portion of the blank as the blank rotates with the drum, and a spiral edge directed toward the drum, extended from the first edge and having a spiral shape gradually advancing in the direction of the drum, wherein, as the drum and the blank disposed thereon rotate, the first surface portion of the blank is guided along the outer convex face toward the first edge, along the first edge, along the spiral edge and along the inner concave face to be folded approximately 180° about the score line onto the second surface portion, the outer convex face, the spiral edge and the inner concave face shaped to fold the first surface portion.

* * * * *